US012385204B2

(12) United States Patent
Suazo

(10) Patent No.: US 12,385,204 B2
(45) **Date of Patent: *Aug. 12, 2025**

(54) DITCH AND CANAL LINER ASSEMBLY

(71) Applicant: AMERICAN LEAK DETECTION IRRIGATION, INC., New Haven, CT (US)

(72) Inventor: Kenneth L. Suazo, Espanola, NM (US)

(73) Assignee: AMERICAN LEAK DETECTION IRRIGATION, INC., New Haven, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/602,172

(22) Filed: Mar. 12, 2024

(65) Prior Publication Data

US 2024/0209582 A1 Jun. 27, 2024

Related U.S. Application Data

(63) Continuation of application No. 17/831,696, filed on Jun. 3, 2022, now Pat. No. 11,959,240, which is a (Continued)

(51) Int. Cl.
*E02B 5/02* (2006.01)

(52) U.S. Cl.
CPC ..... *E02B 5/02* (2013.01)

(58) Field of Classification Search
CPC ... E02B 5/02; E02B 5/08; E02B 5/005; E02B 13/00; E02B 11/005
See application file for complete search history.

(56) References Cited

U.S. PATENT DOCUMENTS 195,989 A 10/1877 Culver
980,442 A 1/1911 Schlafly
(Continued)

FOREIGN PATENT DOCUMENTS

CA 2732245 A1 6/2011
GB 1248204 A 9/1971
(Continued)

OTHER PUBLICATIONS

Matos, Taina (Authorized officer), International Search Report and Written Opinion dated Sep. 1, 2022 from International Application No. PCT/US2022/032063, 7 pages.

*Primary Examiner* — Benjamin F Fiorello
(74) *Attorney, Agent, or Firm* — MH2 Technology Law Group, LLP

(57) ABSTRACT

A ditch liner includes: a first corrugation having first and second angled sections, and a central section; and a second corrugation having first and second angled sections, and a central section. The first angled sections are adjacent to each other, the second angled sections are adjacent to each other, the central sections are adjacent to each other, a width of the first angled section of the first corrugation is different than a width of the first angled section of the second corrugation at a first location, a width of the second angled section of the first corrugation is different than a width of the second angled section of the second corrugation at a second location, and a width of the central section of the first corrugation is equal to a width of the central section of the second corrugation at a third location.

20 Claims, 23 Drawing Sheets

Related U.S. Application Data continuation-in-part of application No. 29/787,534, filed on Jun. 7, 2021, now Pat. No. Des. 1,021,139.

(60) Provisional application No. 63/237,096, filed on Aug. 25, 2021.

(56) References Cited

U.S. PATENT DOCUMENTS

| | | | | |
|---|---|---|---|---|
| 1,515,709 | A | 11/1924 | Stowell | |
| 2,582,515 | A | 1/1952 | Harold | |
| 2,657,074 | A | 10/1953 | Schwester et al. | |
| 3,113,435 | A | 12/1963 | Yount | |
| 3,156,099 | A | 11/1964 | Dailey | |
| 3,313,319 | A | 4/1967 | Osborn et al. | |
| 3,315,704 | A | 4/1967 | Shire | |
| 3,336,950 | A | 8/1967 | Fochler | |
| 3,374,634 | A | 3/1968 | Fochler | |
| 3,383,863 | A | 5/1968 | Berry | |
| 3,417,570 | A | 12/1968 | Pegan et al. | |
| 3,446,025 | A | 5/1969 | Koch | |
| 3,597,928 | A | 8/1971 | Pilaar | |
| 3,611,731 | A | 10/1971 | Edmondson | |
| 3,731,711 | A | 5/1973 | Bauer | |
| 3,735,596 | A | 5/1973 | Stephenson | |
| 3,878,685 | A | 4/1975 | Schmunk | |
| 3,897,090 | A | 7/1975 | Maroschak | |
| 3,926,222 | A | 12/1975 | Shroy et al. | |
| 3,958,425 | A | 5/1976 | Maroschak | |
| 3,995,435 | A * | 12/1976 | Waterston | E02B 13/00 137/527.6 |
| 4,190,988 | A | 3/1980 | Carreiro | |
| 4,257,716 | A | 3/1981 | Woodrow | |
| 4,405,264 | A | 9/1983 | Brady et al. | |
| 4,451,172 | A | 5/1984 | Lamphier et al. | |
| 4,765,775 | A | 8/1988 | Kroger | |
| 4,787,776 | A | 11/1988 | Brady et al. | |
| D299,543 | S | 1/1989 | Phillips | |
| D312,696 | S | 12/1990 | Phillips | |
| 5,015,122 | A | 5/1991 | Combes | |
| 5,038,528 | A | 8/1991 | Brant | |
| 5,193,588 | A | 3/1993 | Kanao | |
| 5,288,168 | A | 2/1994 | Spencer | |
| 5,316,175 | A | 5/1994 | Van Romer | |
| 5,548,931 | A | 8/1996 | Bryant | |
| 5,558,464 | A | 9/1996 | Tassone et al. | |
| 5,669,733 | A | 9/1997 | Daly et al. | |
| 5,685,668 | A | 11/1997 | Justice | |
| 5,689,920 | A | 11/1997 | Hallsten | |
| 5,806,252 | A | 9/1998 | Scuero | |
| 5,810,511 | A | 9/1998 | Schmidt | |
| 5,820,296 | A | 10/1998 | Goughnour | |
| 5,924,461 | A | 7/1999 | Shaw et al. | |
| 5,972,468 | A | 10/1999 | Welch et al. | |
| 6,092,686 | A | 7/2000 | Shaw et al. | |
| 6,141,916 | A | 11/2000 | Shackelford | |
| 6,187,244 | B1 | 2/2001 | Fishel et al. | |
| 6,202,358 | B1 | 3/2001 | Janesky | |
| 6,227,763 | B1 | 5/2001 | Kuhns | |
| 6,270,287 | B1 | 8/2001 | Gray | |
| 6,273,640 | B1 | 8/2001 | Suazo | |
| D447,543 | S | 9/2001 | Quin | |
| D447,544 | S | 9/2001 | Quin | |
| 6,310,284 | B1 | 10/2001 | Ikeda | |
| 6,361,248 | B1 * | 3/2002 | Maestro | E03F 1/003 405/48 |
| 6,450,458 | B1 | 9/2002 | Bernard | |
| 6,634,144 | B1 | 10/2003 | Moore et al. | |
| 6,692,186 | B1 | 2/2004 | Suazo et al. | |
| 6,698,975 | B1 | 3/2004 | Benecke | |
| 6,722,818 | B1 | 4/2004 | Suazo et al. | |
| 6,755,596 | B2 | 6/2004 | Schibi | |
| 6,766,817 | B2 | 7/2004 | Da Silva | |
| 6,817,807 | B1 | 11/2004 | Charon | |
| 6,880,720 | B2 | 4/2005 | Van Romer | |
| 7,025,532 | B2 | 4/2006 | Suazo et al. | |
| 7,156,580 | B2 | 1/2007 | Suazo et al. | |
| 7,165,914 | B2 | 1/2007 | Suazo | |
| 7,226,241 | B2 | 6/2007 | Ditullio | |
| 7,357,600 | B2 | 4/2008 | Suazo et al. | |
| 7,470,085 | B1 | 12/2008 | Suazo | |
| 7,611,129 | B1 | 11/2009 | Stahm | |
| 7,758,282 | B2 | 7/2010 | Suazo | |
| D662,191 | S | 6/2012 | Luke | |
| D673,250 | S | 12/2012 | Luke | |
| 8,425,148 | B2 | 4/2013 | DiTullio | |
| D682,400 | S | 5/2013 | Luke | |
| 8,439,602 | B1 * | 5/2013 | Suazo | E02B 5/02 405/118 |
| 8,491,224 | B2 | 7/2013 | Cobb et al. | |
| D748,289 | S | 1/2016 | Kamil | |
| D748,290 | S | 1/2016 | Khaychenko | |
| D748,825 | S | 2/2016 | Lara | |
| 9,297,135 | B2 | 3/2016 | Suazo | |
| 10,132,070 | B2 | 11/2018 | Madler | |
| D885,613 | S | 5/2020 | Duncan | |
| 11,131,069 | B2 | 9/2021 | Priester | |
| D980,455 | S | 3/2023 | Baker | |
| D987,043 | S | 5/2023 | Turk | |
| 11,959,240 | B2 * | 4/2024 | Suazo | E02B 5/02 |
| 2001/0032418 | A1 | 10/2001 | Richardson | |
| 2002/0094238 | A1 | 7/2002 | Schibi | |
| 2004/0202510 | A1 * | 10/2004 | Suazo | E03F 3/046 405/184.2 |
| 2005/0025572 | A1 | 2/2005 | Sanfilippo et al. | |
| 2005/0196590 | A1 | 9/2005 | Seth et al. | |
| 2005/0271473 | A1 | 12/2005 | Charon | |
| 2006/0072971 | A1 | 4/2006 | Suazo et al. | |
| 2007/0259520 | A1 | 11/2007 | Cooper | |
| 2008/0216420 | A1 | 9/2008 | Brewka | |
| 2009/0067928 | A1 | 3/2009 | Currivan | |
| 2009/0103982 | A1 | 4/2009 | Hodgekins et al. | |
| 2011/0135392 | A1 * | 6/2011 | Zajicek | E02B 13/00 405/121 |
| 2011/0232206 | A1 | 9/2011 | George | |
| 2011/0318109 | A1 | 12/2011 | Miller et al. | |
| 2012/0189810 | A1 | 7/2012 | Whitener | |
| 2013/0048630 | A1 | 2/2013 | Zajicek et al. | |
| 2013/0175427 | A1 | 7/2013 | Moyher | |

FOREIGN PATENT DOCUMENTS

| | | | |
|---|---|---|---|
| GB | 2084209 | A | 4/1982 |
| JP | 07292893 | A | 11/1995 |
| KR | 101126658 | B1 | 3/2012 |
| WO | 9802624 | A1 | 1/1998 |
| WO | 2015172078 | A1 | 11/2015 |

* cited by examiner

DITCH AND CANAL LINER ASSEMBLY

CROSS-REFERENCE TO RELATED APPLICATIONS

This application is a continuation of U.S. patent application Ser. No. 17/831,696, filed Jun. 3, 2022, which is a continuation-in-part of U.S. Design Patent Application Ser. No. 29/787,534, filed Jun. 7, 2021, and claims priority to U.S. Provisional Patent Application No. 63/237,096, filed Aug. 25, 2021, all of which are incorporated by reference herein in their entirety.

FIELD OF THE INVENTION

The invention is directed to a fluid transport lining system. More particularly, embodiments of the invention are directed to a liner for irrigation ditches and canals that provides strength and adaptability, and similar usages such as, for example, other liquid transport such as, for example, in mining.

An example of an application for the invention is a plastic liner for an irrigation ditch.

BACKGROUND OF THE INVENTION

Ditches formed in the earth for conveying water to a point or to an area of use have been common throughout the world for generations. Earthen ditches have been used to transport potable water, irrigation water, and other fluids and materials. Earthen irrigation ditches continue to be significant in the transportation of water because they are readily and inexpensively formed in almost any terrain.

The term "ditch" as used herein is understood to include any excavation dug in the earth, or any structure partially or completely installed above earth, that may be referred to as a drain, channel, canal or acequia, whether lined or unlined, usually but not always relying primarily on gravity to transport fluids and materials along descending elevations.

During transportation of water through earthen ditches that are unlined by a material other than dirt ("unlined ditches"), significant quantities of water are lost because of seepage, erosion, trans-evaporation, and other causes. Tests indicate that as much as 80-90% of water may be lost during transportation through unlined, dilapidated earthen/concrete ditches before the water is delivered to a point of diversion or area for its application and use.

Loss of water from an unlined earthen ditch, referred to as "seepage loss," may be considerable. At least one report issued by New Mexico State University entitled "Field/Laboratory Studies for the Fast Ditch Lining System," dated Feb. 10, 2002, ("Report") indicates the results of tests conducted over a nine-day interval. Total water losses during the nine-day test period were estimated to be 14,245,010 gallons, or 85.8% of total flow, when water was conducted through an unlined earthen ditch. The Report attributes most water losses to existing vegetation overgrowth, tree root systems, gopher holes, evaporation, and seepage or percolation. On the other hand, that same report, based on field measurements taken with a liner system that had been installed in the same earthen ditch showed a total loss of only 7.3% of total flow.

Unlined earthen ditches must be regularly maintained, cleaned, and repaired to avoid loss of water through wall collapse; accumulated debris, absorption through dirt walls, capillary action, and rodent activity, which are some of the many causes of ditch deterioration. Because repair and maintenance of unlined ditches is costly and labor intensive, various methods for lining unlined ditches have been suggested. Those methods include the use of concrete, metal, and polyvinyl chloride materials. Those methods, however, have proven inadequate for a number of reasons including at least cost and unresponsiveness to modern environmental concerns. Some materials, like concrete, are difficult to install in remote geographical areas, are inflexibly positioned once installed, and often require major construction efforts that are neither practical nor affordable based on cost-benefit analyses.

Applicant recognized an improvement to the above arrangement and implements that improvement in embodiments of the invention.

SUMMARY

The Manning's equation is an empirical equation that applies to uniform flow in open channels and is a function of the channel velocity, flow area and channel slope.

Manning's Equation:

$$Q = \mathrm{VA} = \left(\frac{1.49}{n}\right) AR^{\frac{2}{3}} \sqrt{S}\,[U, S.]$$

$$Q = \mathrm{VA} = \left(\frac{1.00}{n}\right) AR^{\frac{2}{3}} \sqrt{S}\,[SI]$$

Where:

Q=Flow Rate, ($ft^3/s$)

v=Velocity, (ft/s)

A=Flow Area, ($ft^2$)

n=Manning's Roughness Coefficient

Under uniform flow conditions. the bottom slope is the same as the slope of the energy grade line and the water surface slope. In Manning's Equation, n is a coefficient which represents the roughness or friction applied to the flow by the channel. n-values are often selected from tables, but can also be calculated from field measurements.

The Manning's coefficient increases as the depth of flow is increased based on the corrugation design. The increase in the Manning's coefficient (which is a coefficient of friction) is proportional to the increase in surface area of the corrugations and/or change in corrugation height as they increase on the side slopes of trapezoidal (angled) sections, as well as the increasing the throat distance between centerlines of each corrugation. In one embodiment of the invention, the liner system, as disclosed herein, does not include one or more of the following: corrugations that are flat on the top of the corrugations, and corrugations that are consistent in corrugation width across the top along the entire length. In one embodiment, the distance from a centerline of a corrugation to a centerline of an adjacent corrugation is constant along the length of the two adjacent corrugations. In one embodiment, the distance from the centerline of a corrugation to the centerline of an adjacent corrugation is not constant along the length of the two adjacent corrugations.

In one embodiment of the liner system, the distance across the top of asymmetrical radial, curved, or domed corrugations is reduced proportionally with respect to the top width of the corrugation at various cross sections. For example, the top width of a cross section at a first location is at least about 3.88", reduces in width to at least about 2.75" at a second location. Also, the height is reduced from at least about 2.15" at the first location to at least about 1.74" at the second location, where the corrugation is symmetrical at the second location only. The increase in the height and width of the corrugation increases the surface area thus increasing the Manning's coefficient of friction. In one embodiment, with the increase in Manning's coefficient of friction with respect to the increase in water depth of flow, the drag on the side walls increases and the water at the bottom of the liner will flow faster, thus creating a scouring velocity which will move dirt and small particulate soils downstream in the liner to the point of discharge.

In other embodiments, the particular dimensions of the liner system can be altered from those in the forgoing example; however, it can be advantageous to keep the proportional relationship of the various dimensions substantially similar, for example within 25%. For example, in a liner system in accordance with embodiments of the invention, the distance across the top of the asymmetrical radial, curved, or domed corrugations is reduced proportionally with respect to the top width of the corrugation at a particular location. For example, at a first location on a first angled section, the top starting width of the corrugation has a width at least about 1 unit of measure, reduces in width to at least about 0.708 units (at least about 70.8% of the top starting width) at a central section, while the height of the corrugation is also reduced in height from at least about 0.554 units (at least about 55.4% of the top starting width) at the first location to at least about 0.448 units (at least about 44.8% of the top starting width) at the central section. In embodiments, the corrugation is symmetrical (constant width and height) at the central section, and only at the central section.

Embodiments of the invention achieves the benefit of reducing the drag caused by the corrugations, while maintaining a desired minimum strength of the liner system, and providing flexibility in the liner system that allows bending of individual units of the liner system to conform to irregularities in the earthen or concrete ditches.

Particular embodiments of the invention are directed to a ditch liner having a longitudinal direction and a transverse direction perpendicular to the longitudinal direction. The ditch liner includes: a first corrugation extending in the transverse direction, and having a first angled section having a width in the longitudinal direction, a second angled section having a width in the longitudinal direction, and a central section positioned between the first angled section and the second angled section and having a width in the longitudinal direction; and a second corrugation extending in the transverse direction and having a first angled section having a width in the longitudinal direction, a second angled section having a width in the longitudinal direction, and a central section positioned between the first angled section of the second corrugation and the second angled section of the second corrugation and having a width in the longitudinal direction. The first angled section of the first corrugation is adjacent to the first angled section of the second corrugation in the longitudinal direction, the second angled section of the first corrugation is adjacent to the second angled section of the second corrugation in the longitudinal direction, the central section of the first corrugation is adjacent to the central section of the second corrugation in the longitudinal direction, the width of the first angled section of the first corrugation is different than the width of the first angled section of the second corrugation at a first location along the transverse direction, the width of the second angled section of the first corrugation is different than the width of the second angled section of the second corrugation at a second location along the transverse direction, and the width of the central section of the first corrugation is equal to the width of the central section of the second corrugation at a third location along the transverse direction.

In particular embodiments, the width of the central section of the first corrugation is equal to the width of the central section of the second corrugation at all locations along the transverse direction.

In particular embodiments, the width of the first angled section of the first corrugation is different at different locations along the transverse direction.

In particular embodiments, the width of the second angled section of the first corrugation is different at different locations along the transverse direction.

In particular embodiments, the width of the central section of the first corrugation is constant at all locations along the transverse direction.

In particular embodiments, the first angled section of the first corrugation has a height perpendicular to its width, the first angled section of the second corrugation has a height perpendicular to its width, and the height of the first angled section of the first corrugation at the first location is different than the height of the first angled section of the second corrugation at the first location.

In particular embodiments, the second angled section of the first corrugation has a height perpendicular to its width, the second angled section of the second corrugation has a height perpendicular to its width, and the height of the second angled section of the first corrugation at the second location is different than the height of the second angled section of the second corrugation at the second location.

In particular embodiments, the central section of the first corrugation has a height perpendicular to its width, the central section of the second corrugation has a height perpendicular to its width, and the height of the central section of the first corrugation at the third location is equal to the height of the central section of the second corrugation at the third location.

In particular embodiments, the first corrugation includes a first upper section extending from the first angled section of the first corrugation such that the first angled section of the first corrugation is positioned between the first upper section and the central section of the first corrugation.

In particular embodiments, an anchor port is located in the first upper section, and an anchor port lock attached to the anchor port.

Particular embodiments include an anchor configured to engage earth below the first upper section, and a cable connecting the anchor to the anchor port lock.

In particular embodiments, the cable and the anchor port lock are located entirely below an upper surface of the first upper section.

In particular embodiments, the first angled section is in a first plane, the second angled section is in a second plane, the first central section is in a third plane, and the first plane, the second plane, and the third plane are all different planes.

Particular embodiments include a first edge corrugation that is located on an edge of the ditch liner in the longitudinal direction, the first edge corrugation having a gasket-receiving recess, and the gasket-receiving recess is configured to receive a gasket positioned between the gasket-receiving recess and an edge corrugation of a second ditch liner such that the gasket is located between the gasket-receiving recess and the edge corrugation of the second ditch liner.

Particular embodiments include the gasket, and the gasket is a hydrophilic material.

Particular embodiments include a flow port extending from the first angled section in the transverse direction, the flow port having an opening configured to allow a liquid contained by the ditch liner to exit the ditch liner through the opening.

Particular embodiments include a gate positioned at the opening, the gate being movable between a closed position at which the liquid is prevented from passing through the opening, and an open position at which the liquid can pass through the opening.

In particular embodiments, a length of the ditch liner in the longitudinal direction is different at different locations along the transverse direction.

In particular embodiments, the length of the ditch liner increases from a minimum length at one end in the transverse direction to a maximum length at an opposite end in the transverse direction.

In particular embodiments, a ditch liner assembly includes a plurality of the ditch liners assembled together such that the ends of two adjacent ones of the ditch liners having a minimum length are connected to each other, and the ends of the two adjacent ditch liners having a maximum length are connected to each other.

BRIEF DESCRIPTION OF THE DRAWINGS

The following figures form part of the present specification and are included to further demonstrate certain aspects of the disclosed features and functions and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

As explained above, embodiments of the invention provide an improvement to a liner system for ditches and canals. Embodiments of the invention employ a series of corrugations of a particular shape and orientation to provide strength while also allowing bending of the liner to conform to irregularities in an earthen ditch.

Figure 1:
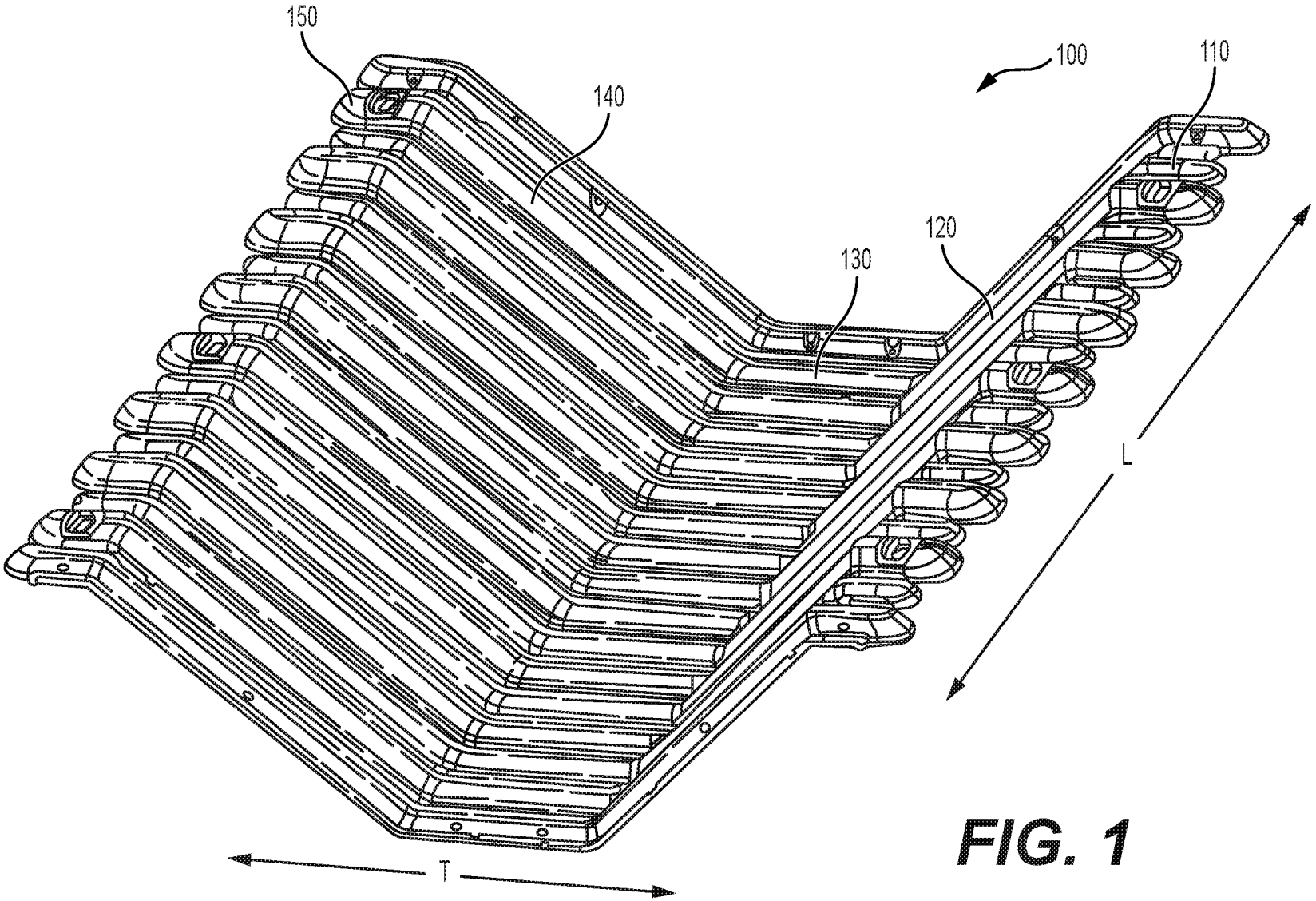
FIG. 1 is a perspective view of an exemplary liner section in accordance with embodiments of the invention.

FIG. 1 shows an example of a ditch liner 100 in accordance with embodiments of the invention. In this example, liner 100 has a plurality of corrugations that each extend in a transverse direction T of liner 100. A longitudinal direction L is a direction in which water flows in liner 100. Multiple liners 100 are connected to each other at their longitudinal ends to form a liner assembly for lining, for example, an earthen ditch. In this example, liner 100 has a first upper section 110 and a second upper section 150 that extend horizontally in the transverse direction. First and second upper sections 110, 150 are configured to be positioned on top of opposing banks of the earthen ditch. A first angled section 120 extends from first upper section 110 at an angle configured to follow a side contour of the earthen ditch. Similarly, a second angled section 140 extends from second upper section 150 at an angle configured to follow a side contour of the earthen ditch. A central section 130 joins first angled section 120 and second angled section 140 and is configured to follow a horizontal bottom contour of the earthen ditch. Also shown in FIG. 1 are joining corrugations 105, 106 that are configured to overlap corresponding joining corrugations 106, 105 of adjoining liners 100 to attach adjoining liners 100.

Figure 2:
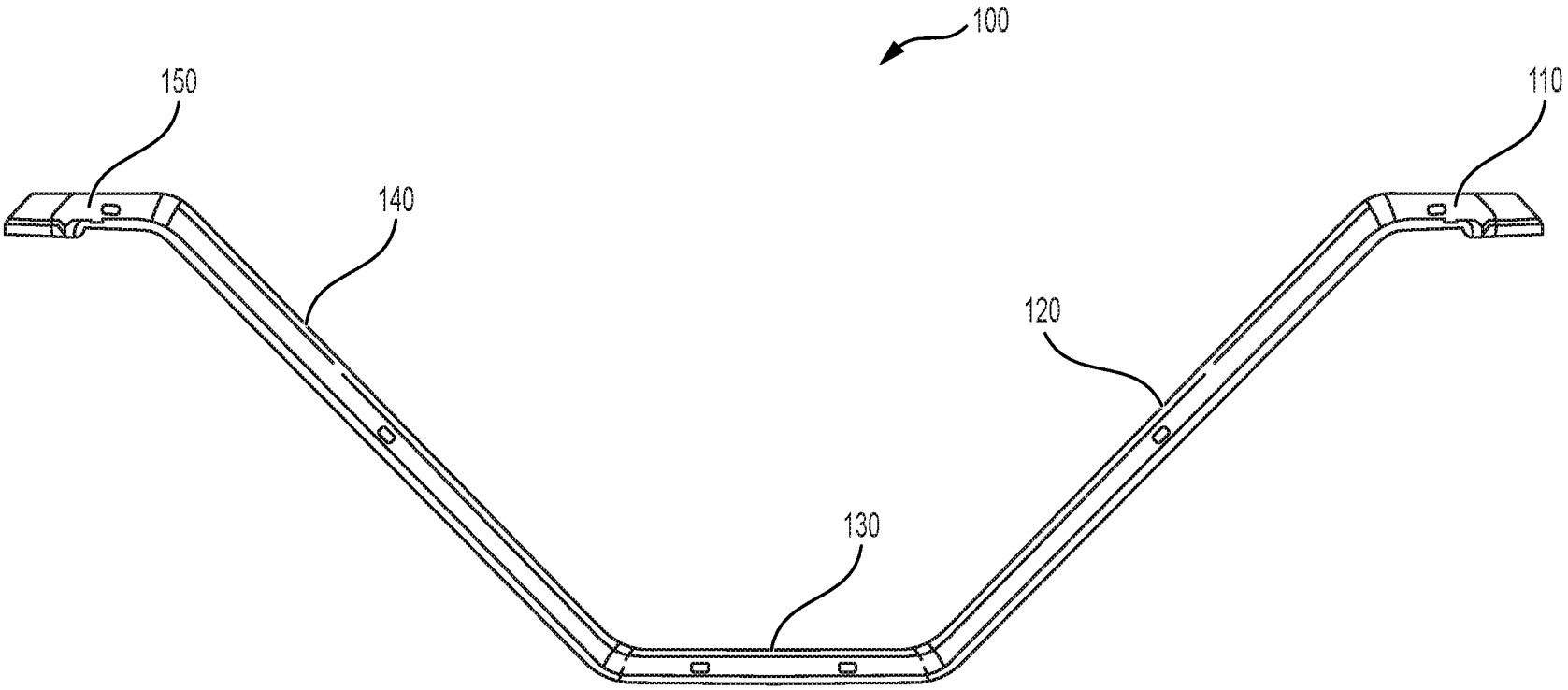
FIG. 2 is an end view of the liner section shown in FIG. 1.
Figure 3:
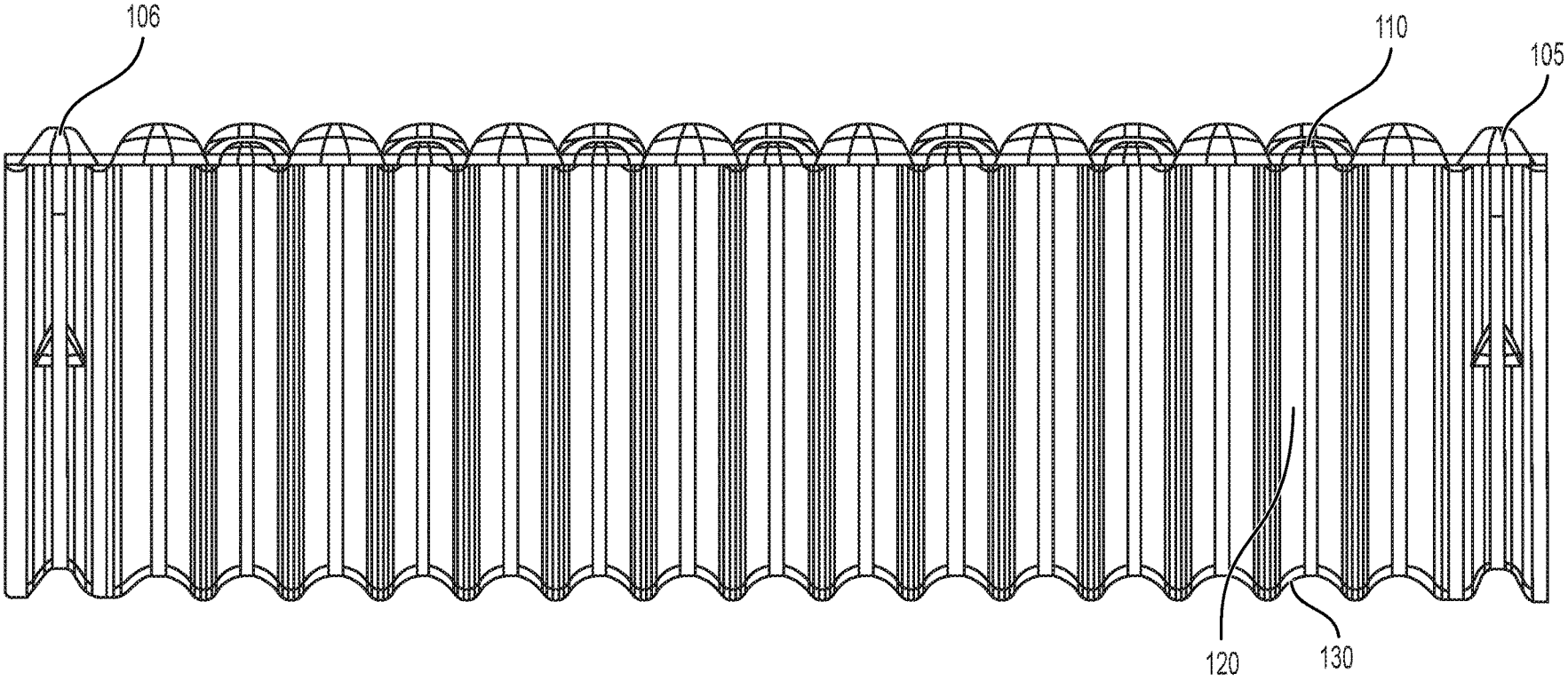
FIG. 3 is a side view of the liner section shown in FIG. 1.
Figure 4:
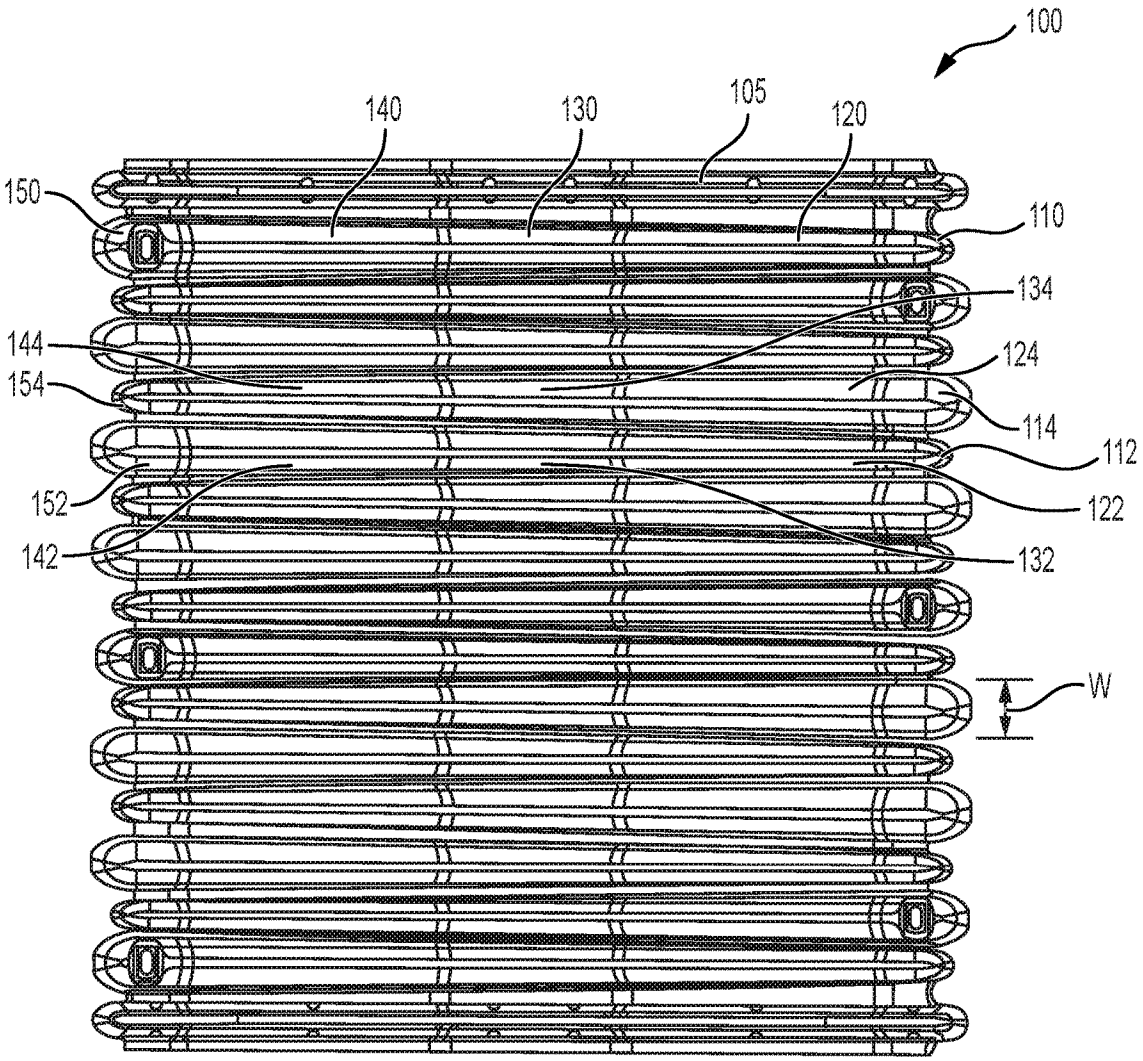
FIG. 4 is a top view of the liner section shown in FIG. 1.
Figure 5:
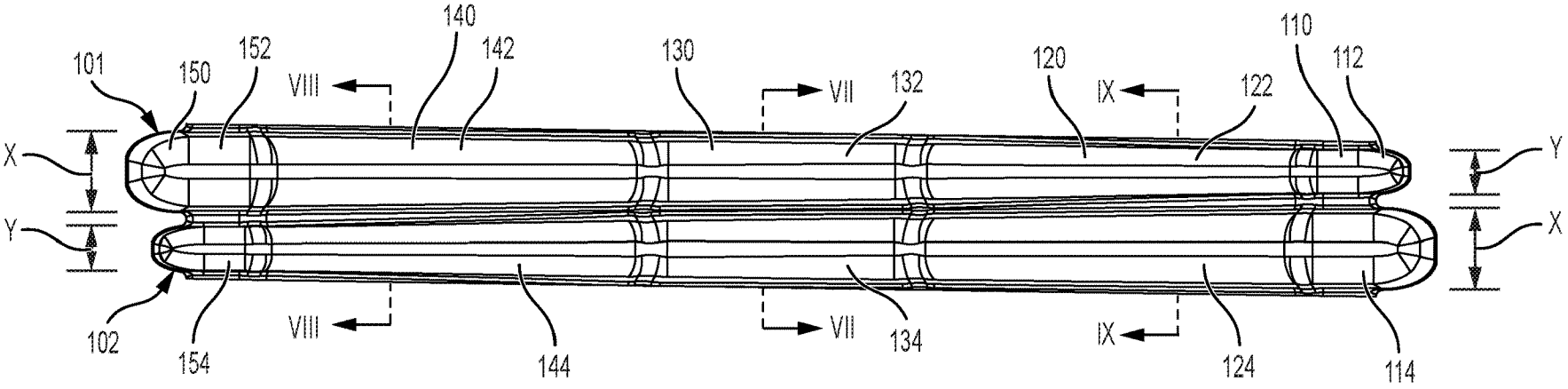
FIG. 5 is a partial top view of the liner section shown in FIG. 1.

FIG. 2 is an end view of liner 100 and further shows the orientation of the sections of liner 100. FIG. 3 is a side view of liner 100. FIG. 4 is a top view of liner 100 and shows that a width W of the various corrugations of liner 100 varies at different locations along the transverse direction T. FIG. 5 is a top view of two adjacent corrugations 101, 102 of liner 100 at a larger scale to show in detail the shape of the corrugations in this example.

As illustrated in FIG. 5, corrugation 101 has a width X at a second upper section 152 and a width Y at a first upper section 112. Corrugation 102 has a width X at a first upper section 114 and a width Y at a second upper section 154. In this example, width Y is less than width X. In embodiments, Y is 50% of X. In other embodiments, Y is some other percentage of X. In this example, corrugation 102 is a mirror image of corrugation 101 such that the end having a width X is positioned adjacent to the end of corrugation 102 having a width Y. In this example, the plurality of corrugations combine to form a straight liner 100 which is at least substantially the same length along each edge. An overall width of liner 100 in transverse direction T is scalable, however, in particular embodiments, angled sections 120, 140 maintain about a 1:1 slope or rise over run ratio. As shown in FIG. 5, corrugation 101 has a central section 132 having a constant width Z. Corrugation 101 has a first angled section 122 that transitions from width Y where first angled section 122 adjoins first upper section 112 to width Z where first angled section 122 adjoins a central section 132. Corrugation 101 has a second angled section 142 that transitions from width Z where second angled section 142 adjoins central section 132 to width X where second angled section 142 adjoins second upper section 152. Similarly, corrugation 102 has a central section 134 having a constant width Z. Corrugation 102 has a first angled section 124 that transitions from width X where first angled section 124 adjoins first upper section 114 to width Z where first angled section 124 adjoins central section 134. Corrugation 102 has a second angled section 144 that transitions from width Z where second angled section 144 adjoins central section 134 to width Y where second angled section 144 adjoins second upper section 154.

Figure 6:
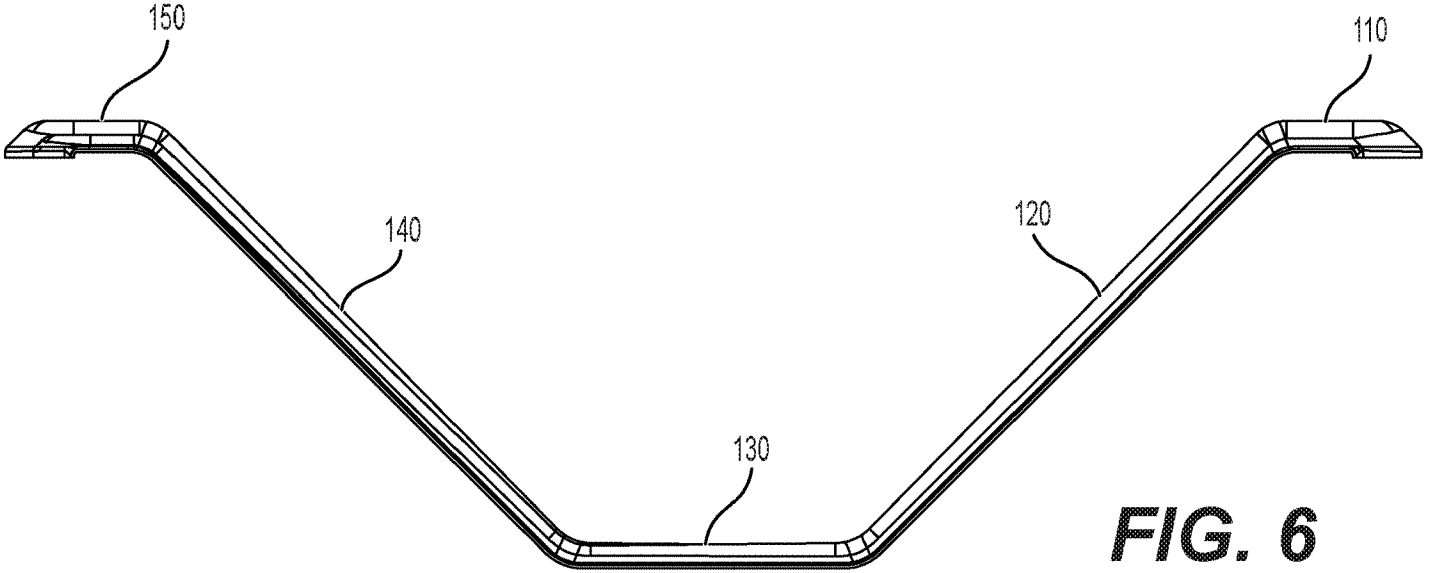
FIG. 6 is an end view of the liner section shown in FIG. 1.
Figure 7:
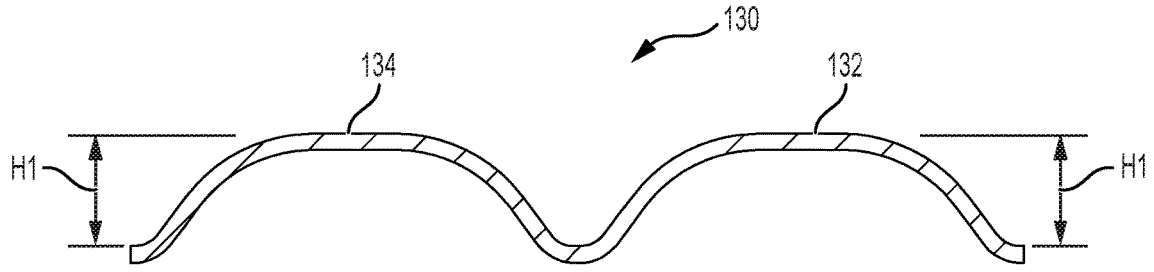
FIG. 7 is a sectional view taken at section line VII-VII in FIG. 6.
Figure 8:
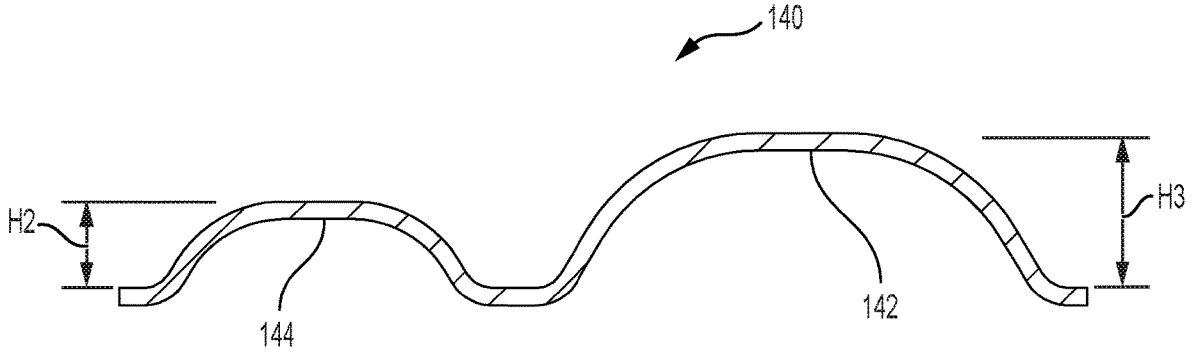
FIG. 8 is a sectional view taken at section line VIII-VIII in FIG. 6.
Figure 9:
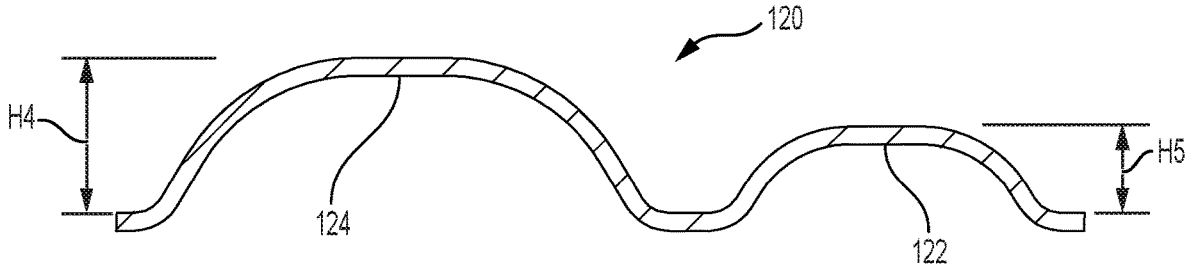
FIG. 9 is a sectional view taken at section line IX-IX in FIG. 6.

FIG. 6 is an end view of liner 100 indicating the locations of three cross-sectional views shown in FIGS. 7-9. FIG. 7 is a cross-sectional view of corrugations 101, 102 taken at section line VII-VII in FIG. 6, which is through central sections 132, 134. As shown in FIG. 7, both central section 132 and central section 134 have a height H1. In other embodiments, central section 132 can have a height that is different from the height of central section 134. FIG. 8 is a cross-sectional view of corrugations 101, 102 taken at section line VIII-VIII in FIG. 6, which is through second angled sections 142, 144. As shown in FIG. 8, second angled section 144 has a height H2 and second angled section 142 has a height H3. In this example, height H3 is larger than height H2. In other embodiments, the relative sizes of H2 and H3 are different than those shown in FIG. 8. FIG. 9 is a cross-sectional view of corrugations 101, 102 taken at section line IX-IX in FIG. 6, which is through first angled sections 122, 124. As shown in FIG. 9, first angled section 124 has a height H4 and first angled section 122 has a height H5. In this example, height H4 is larger than height H5. In other embodiments, the relative sizes of H4 and H5 are different than those shown in FIG. 9.

In the embodiment shown in FIGS. 1-9, the corrugations alternate between corrugation 101 and corrugation 102 to form liner 100.

Figure 10:
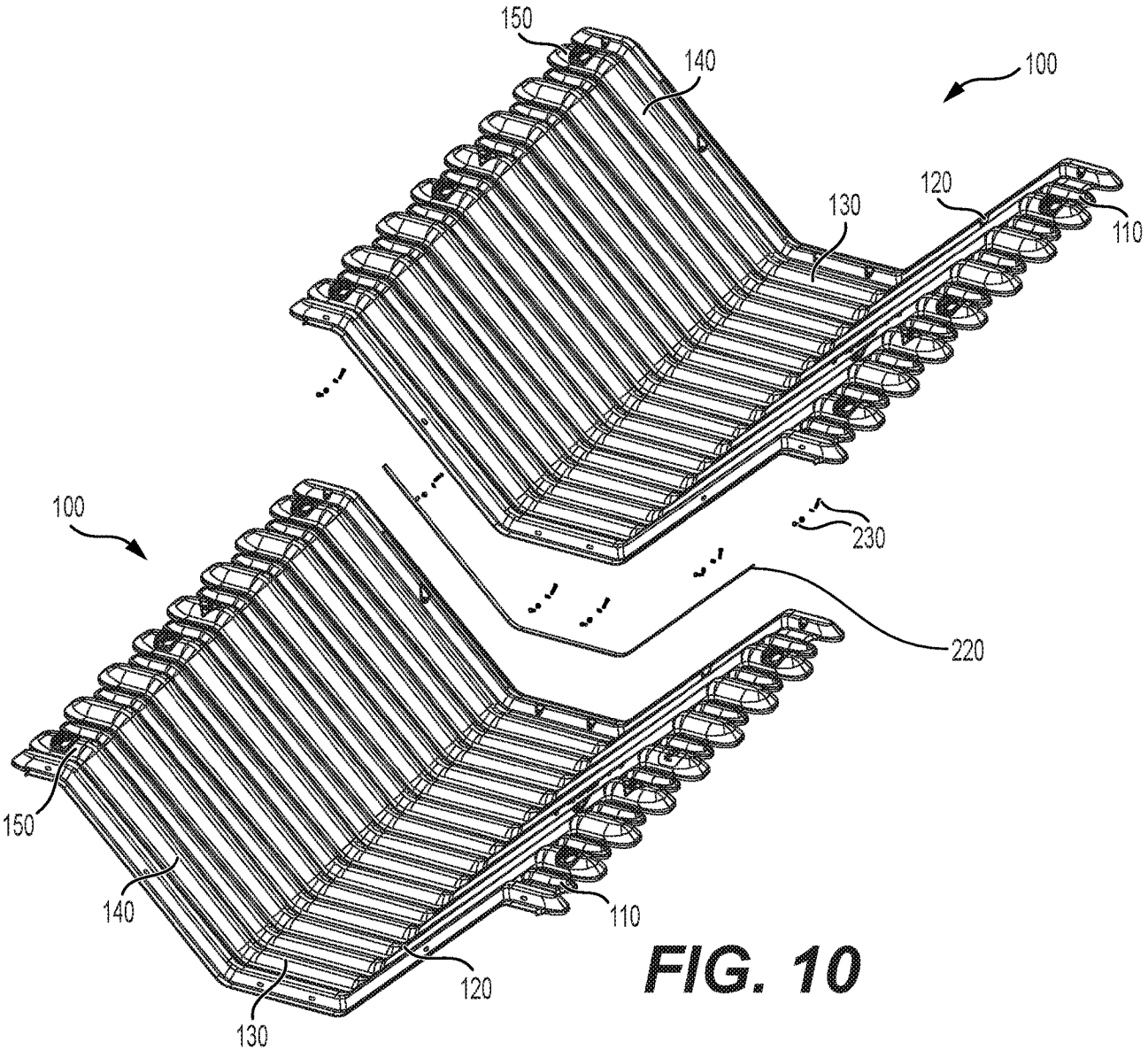
FIG. 10 is a perspective view of two liner sections in accordance with embodiments of the invention prior to the two liner sections being connected.
Figure 11:
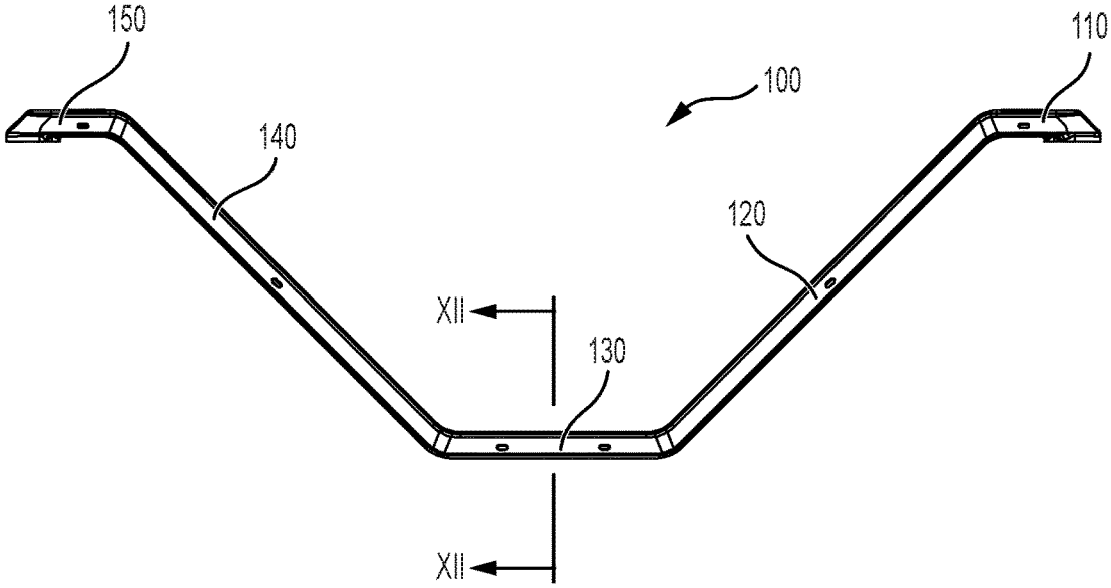
FIG. 11 is an end view of the liner sections shown in FIG. 10 in a connected state.
Figure 12:
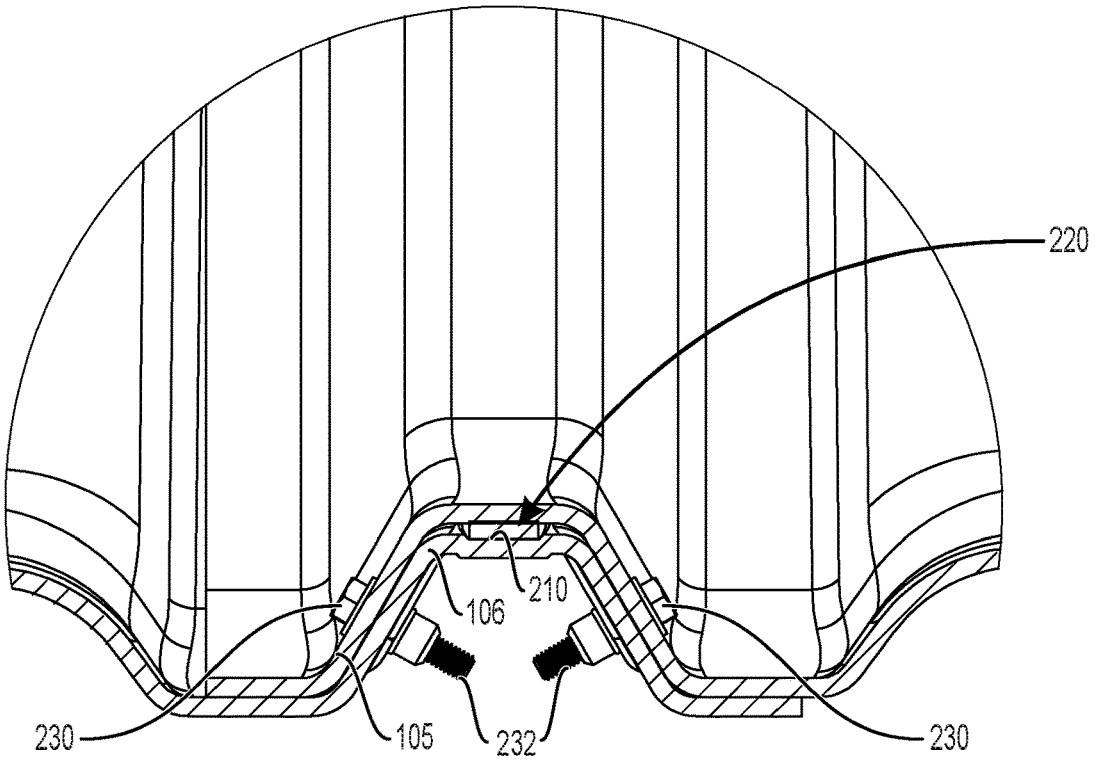
FIG. 12 is a sectional view taken at section line XII-XII in FIG. 11.

FIG. 10 shows two liners 100 in position to be assembled to one another. FIG. 11 is an end view of liner 100 showing the location of the cross-sectional view shown in FIG. 12. FIGS. 10 and 12 show joining corrugation 105 which overlaps joining corrugation 106. A recess 210 is provided in joining corrugation 106 to receive a gasket 220 that forms a seal between joining corrugations 105, 106. In embodiments, gasket 220 is a hydrophilic material that swells when contacted by water to further seal the space between joining corrugations 105, 106 at the location of gasket 220. In this example, joining corrugations 105, 106 are mechanically attached to each other by a plurality of bolts 230 and corresponding nuts 232. In other embodiments, other connection mechanisms can be used.

Figure 13:
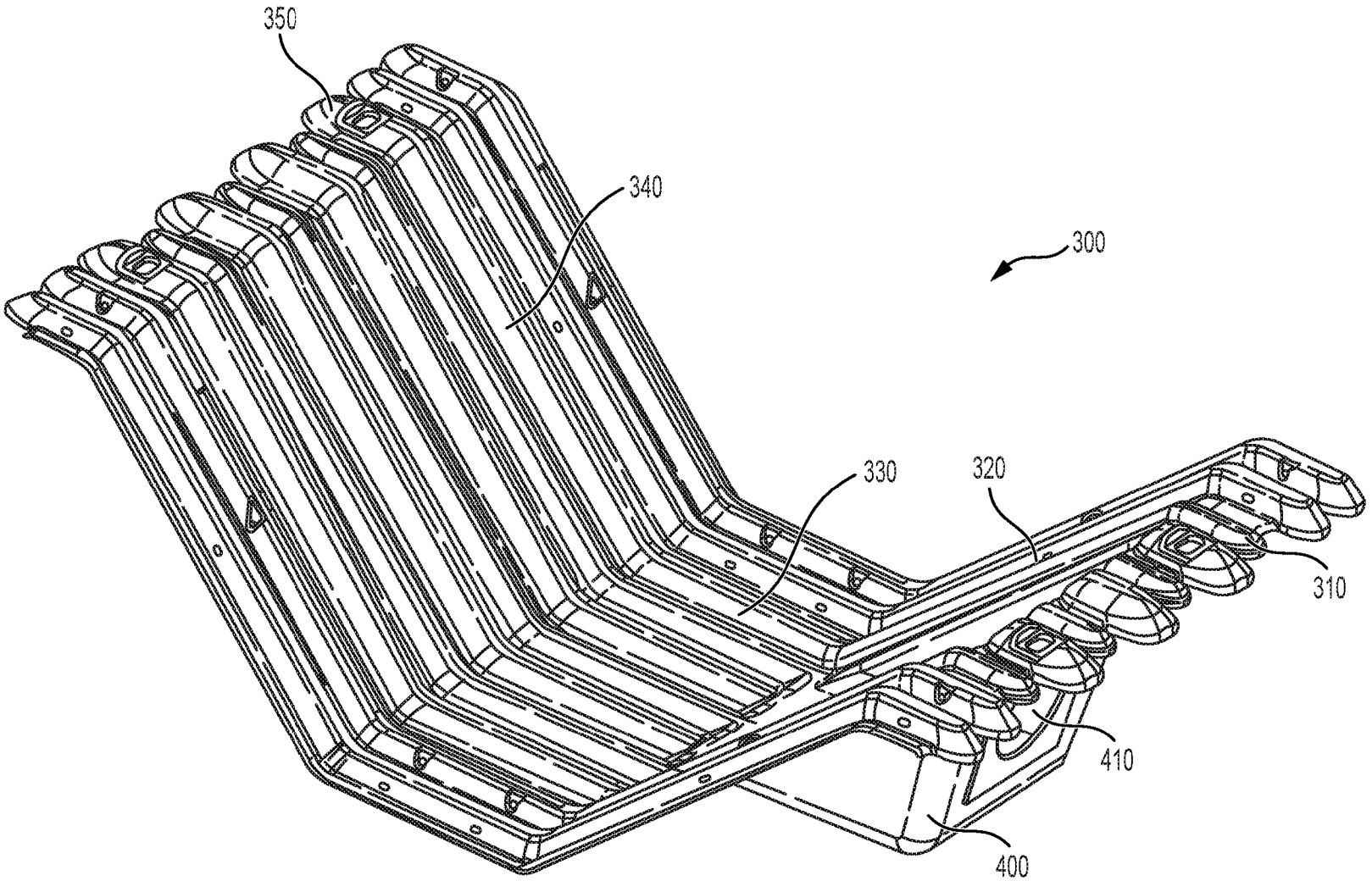
FIG. 13 is a perspective view of an exemplary liner section in accordance with embodiments of the invention.

FIG. 13 illustrates a corrugated outlet liner section 300, which, in this example, has a plurality of corrugations with joining corrugations 305, 306 for forming a mechanical male/female overlapping connection on each end (similar to joining corrugations 105, 106 described above) and having an outlet port 410 in an outlet basin 400 formed in a side of section 300. In embodiments, outlet basin 400 is molded into the side of section 300 and includes a reinforced side. For example, outlet basin 400 is molded to mate with a toggle gate (shown in FIG. 18) for the diversion of fluid that will flow therethrough. The.

Figure 14:
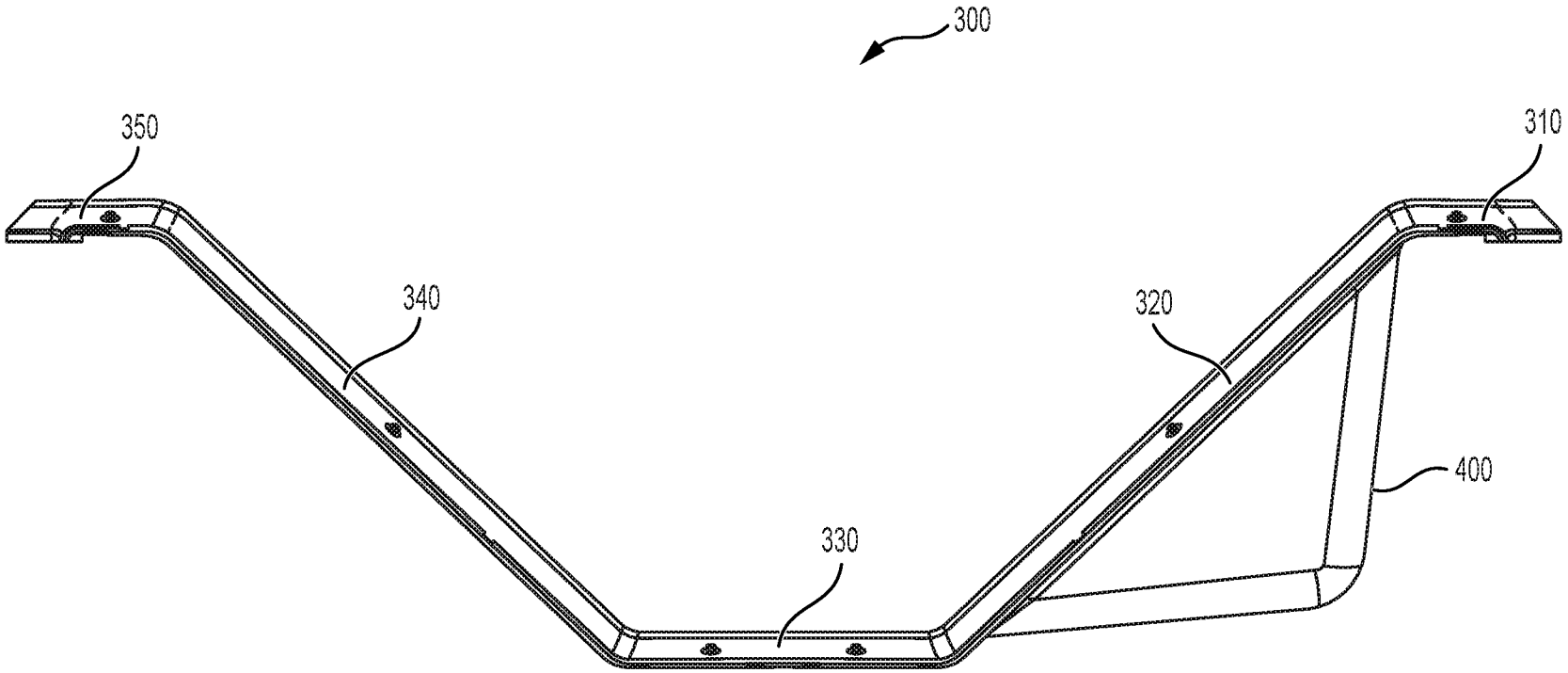
FIG. 14 is an end view of the liner section shown in FIG. 13.
Figure 15:
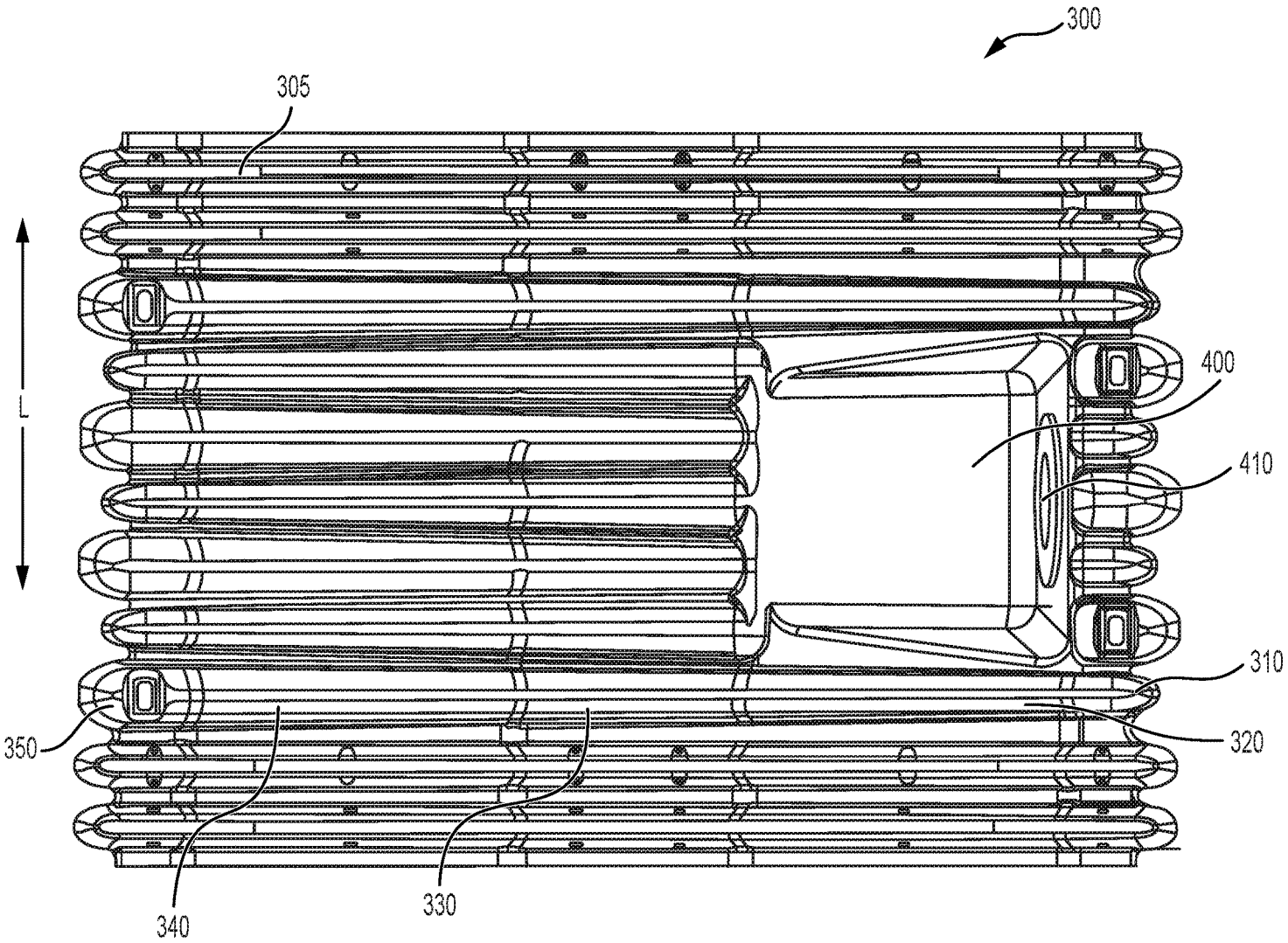
FIG. 15 is a top view of the liner section shown in FIG. 13.

FIG. 14 is an end view of liner section 300 with ends of adjacent separate liner sections 300 arranged to overlap in a male-female configuration with one end with the male configuration/shape and the opposite end has the female configuration/shape. In this example, outlet basin 400 is at least substantially perpendicular to the longitudinal direction L of liner section 300. In other embodiments, outlet basin 400 is not perpendicular to longitudinal direction L and is disposed at any desired angle to facilitate connection to an outlet pipe. FIG. 15 is a top view of liner section 300 and shows sections 310, 320, 330, 340, 350 that correspond to sections 110, 120, 130, 140, 150, respectively from FIG. 1.

Figure 16:
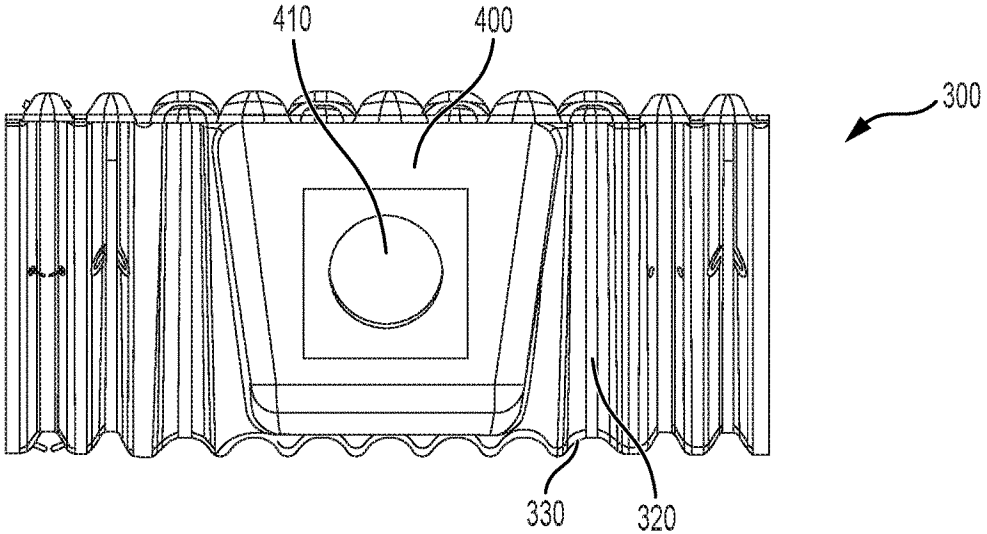
FIG. 16 is a side view of the liner section shown in FIG. 13.
Figure 17:
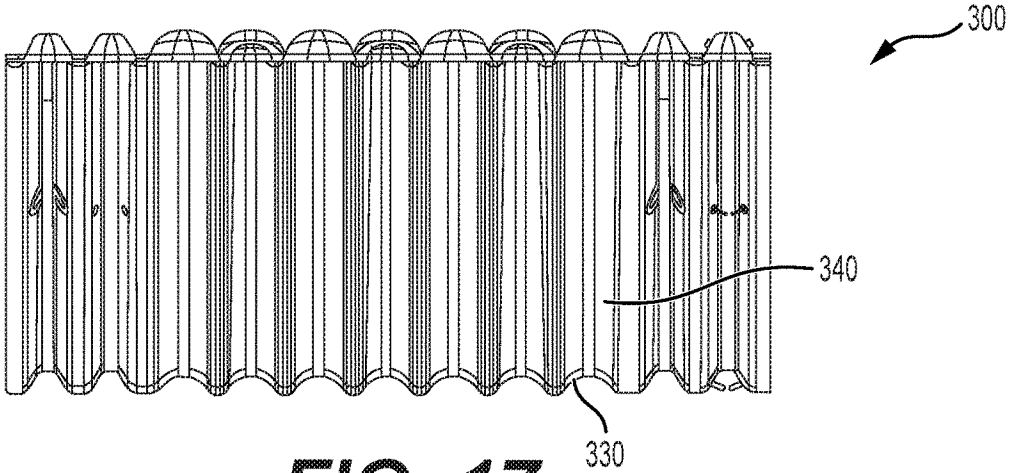
FIG. 17 is a side view of the liner section shown in FIG. 13.

FIG. 16 is the side view of liner section 300 showing outlet basin 400 and outlet port 410, as well as a first angled section 320 that corresponds to first angled section 120 in FIG. 1. FIG. 17 is a side view of the side of liner section 300 that is opposite outlet basin 400 and shows a second angled section 340 that corresponds to second angled section 140 in FIG. 1.

Figure 18:
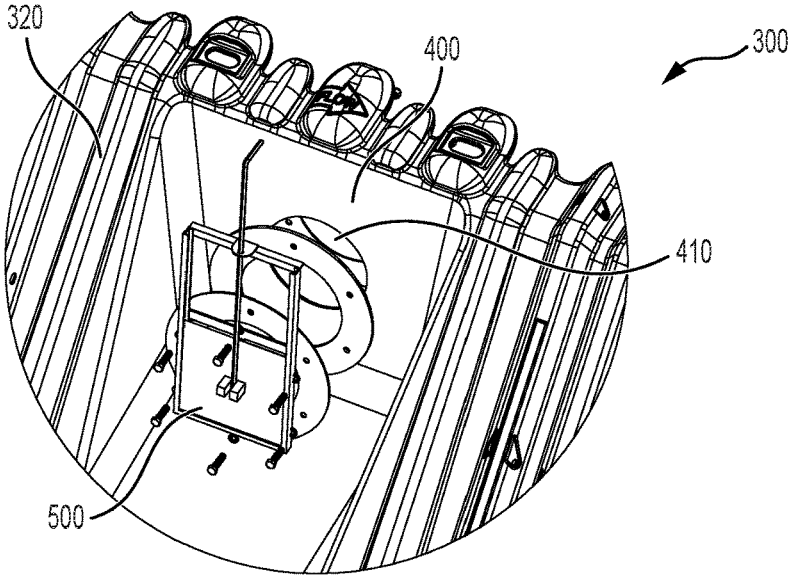
FIG. 18 is a partial perspective view of the liner section shown in FIG. 13.
Figure 19:
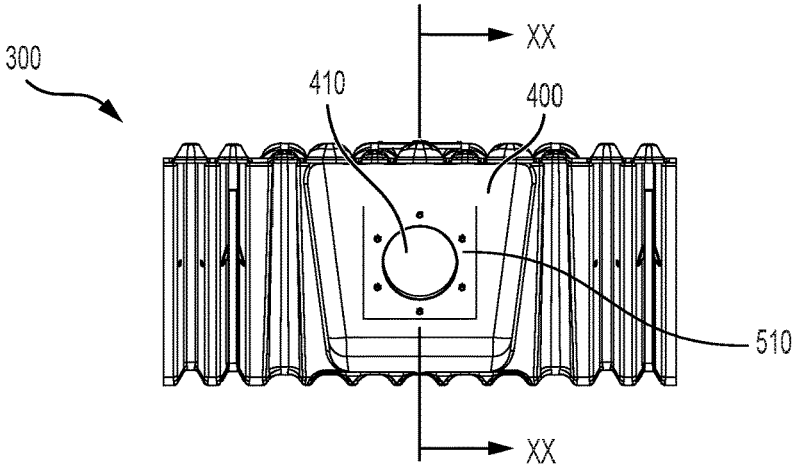
FIG. 19 is a side view of the liner section shown in FIG. 13.
Figure 20:
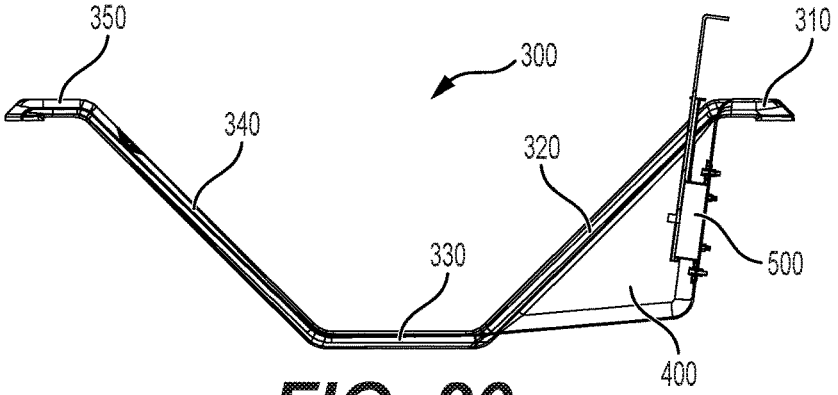
FIG. 20 is a sectional view taken at section line XX-XX in FIG. 19.

FIG. 18 is an exploded view of outlet basin 400 in liner section 300. As shown in FIG. 18, a toggle gate 500 is attached to outlet basin 400 to selectively allow water to flow from liner section 300 out of outlet port 410. FIG. 19 is a side view of liner section 300 showing a backing plate 510 that supports the mechanical fastening of toggle gate 500 to outlet basin 400. FIG. 20 is a sectional view at section line XX-XX in FIG. 19 and shows toggle gate 500 in outlet basin 400.

Figure 21:
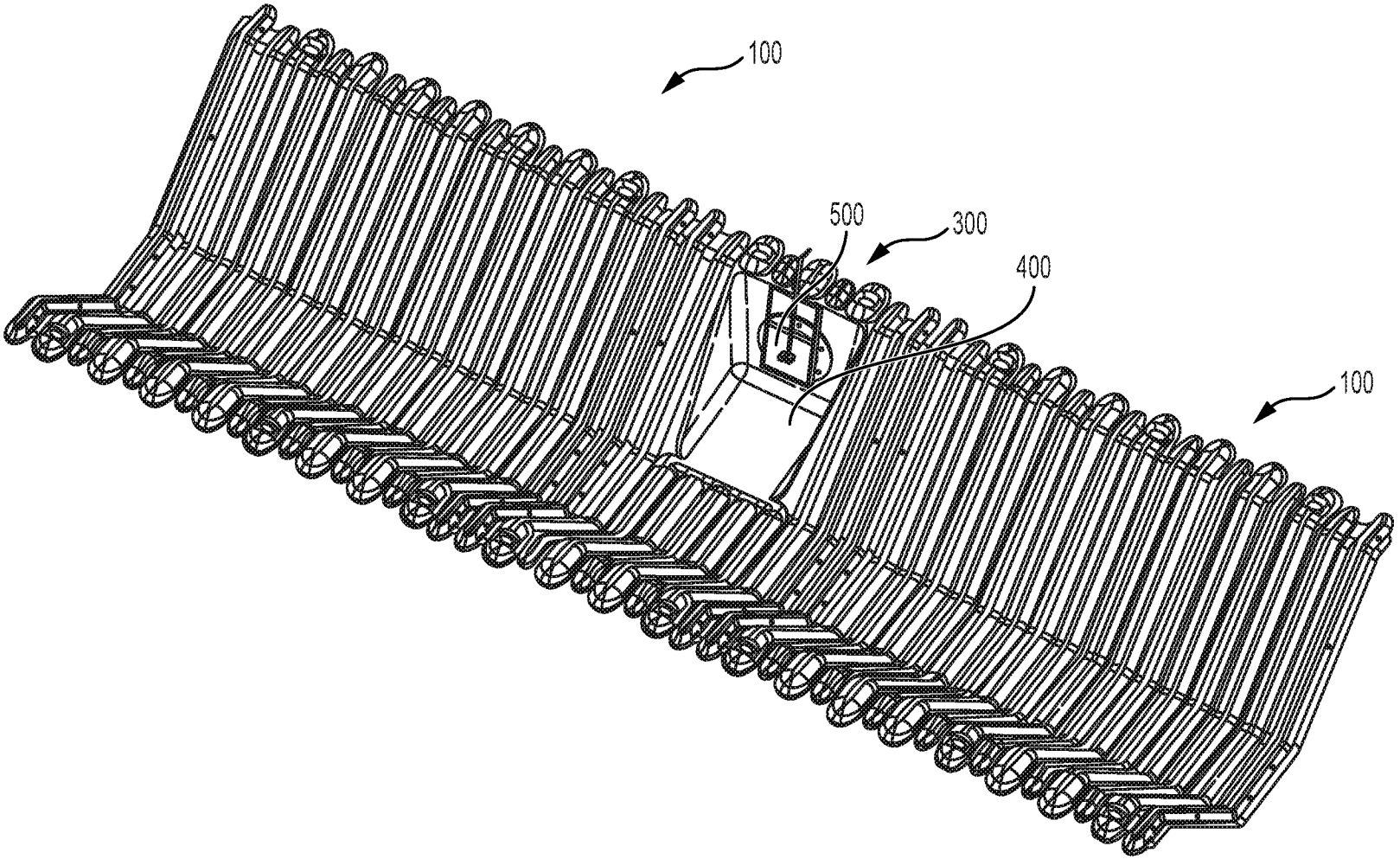
FIG. 21 is a perspective view of the liner section shown in FIG. 13 attached to two of the liner section shown in FIG. 1.
Figure 22:
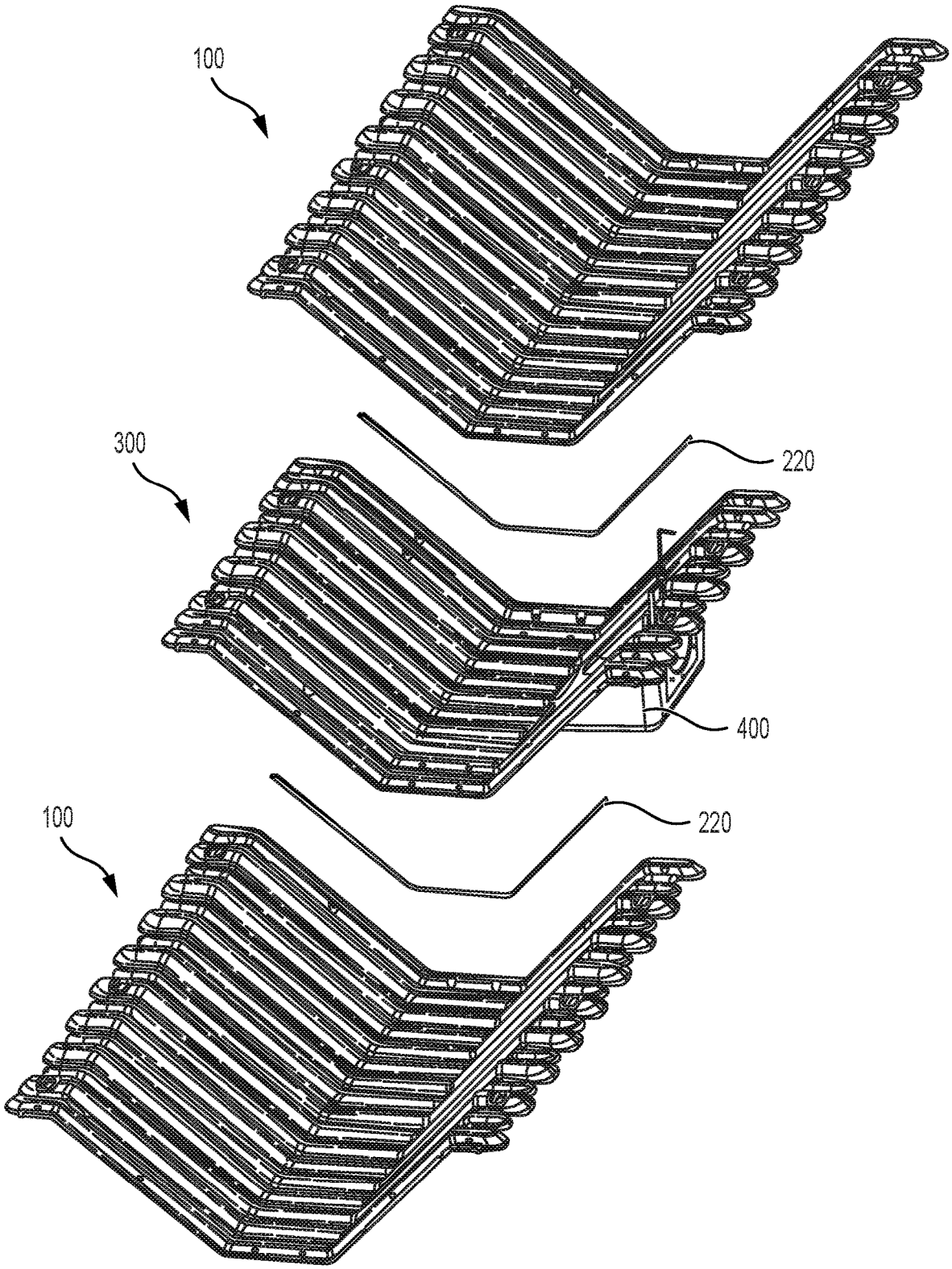
FIG. 22 is a perspective view of the liners sections shown in FIG. 21 in an unassembled state.

FIG. 21 shows outlet liner section 300 in an operating position between two liners 100 to form a straight section of ditch liner having outlet basin 400 and outlet port 410. FIG. 22 shows the assembly shown in FIG. 21 prior to assembly, including gaskets 220. The assembly of outlet liner section 300 to the two liners 100 is similar to that described with respect to FIG. 10.

Figure 23:
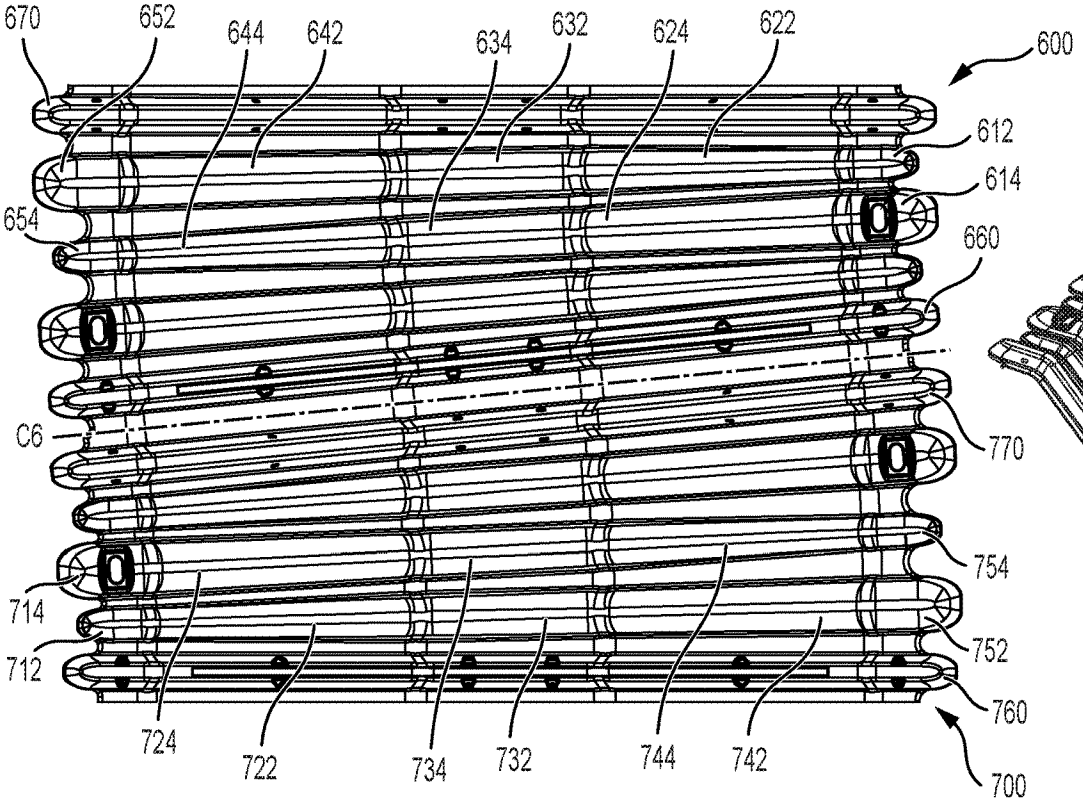
FIG. 23 is a top view of two exemplary liner sections in accordance with embodiments of the invention.

FIGS. 23-27 illustrate a liner section that is designed to facilitate a left-hand turn or a right-hand turn due to the angle induced by the spacing of the corrugations of the liner. Two different liners sections 600, 700 are described for left-hand and right-hand turns so that the mechanical connection (joining corrugations) are configured to correctly mate with corresponding joining corrugations in other liner sections such as outlet liner section 300 and liner 100. FIG. 23 shows a right-hand liner section 600 attached to a left-hand liner section 700. Right-hand liner section 600 has sections 612, 622, 632, 642, 652, 614, 624, 634, 644, 654 that correspond to sections 112, 122, 132, 142, 152, 114, 124, 134, 144, 154, respectively, shown in FIG. 5. Right-hand liner section 600 has joining corrugations 660, 670 that correspond to joining corrugations 105, 106 shown in FIG. 1. Left-hand liner section 700 has sections 712, 722, 732, 742, 752, 714, 724, 734, 744, 754 that correspond to sections 112, 122, 132, 142, 152, 114, 124, 134, 144, 154, respectively, shown in FIG. 5. Left-hand liner section 700 has joining corrugations 760, 770 that correspond to joining corrugations 105, 106 shown in FIG. 1.

Figure 24:
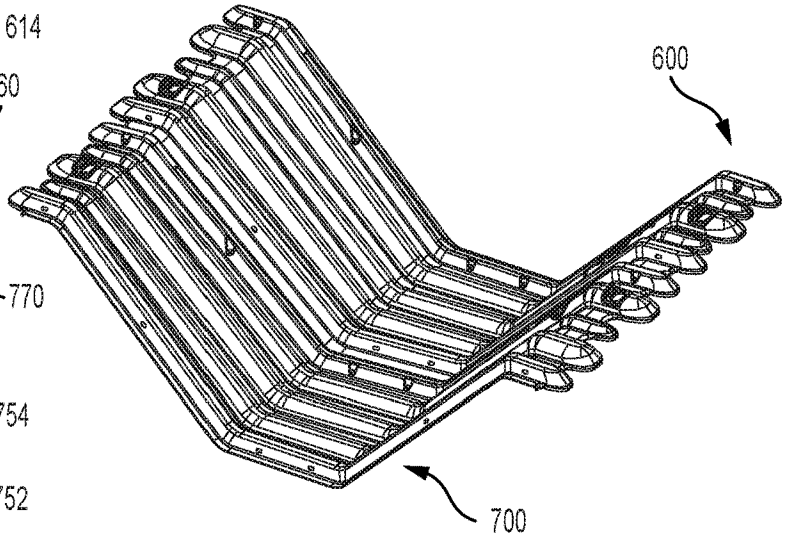
FIG. 24 is a perspective view of the liner sections shown in FIG. 23.
Figure 25:
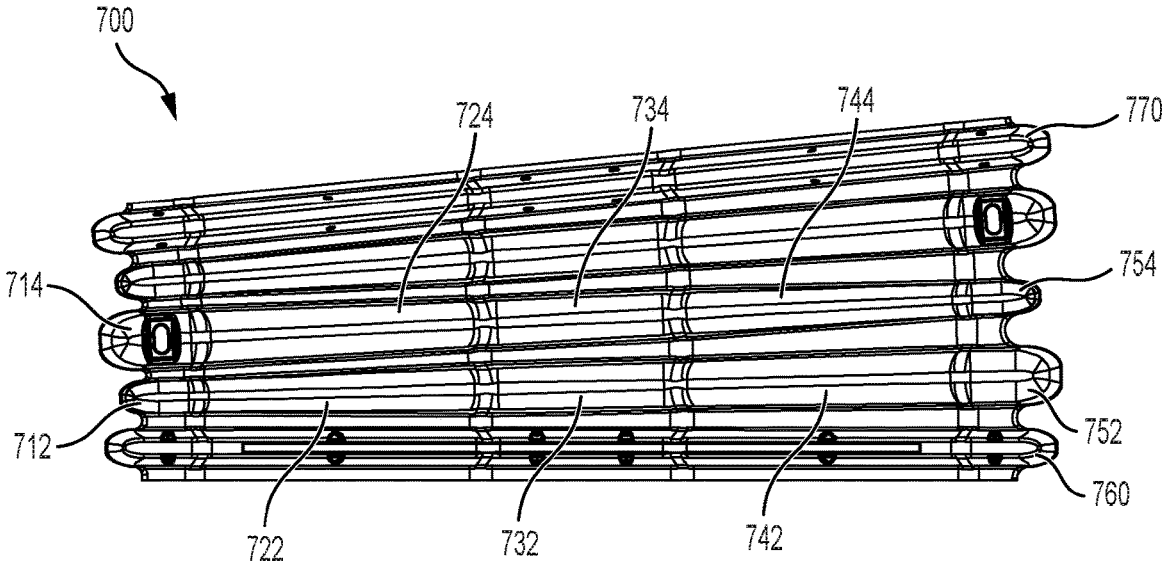
FIG. 25 is a top view of one of the liner sections on one side of centerline shown in FIG. 23.
Figure 26:
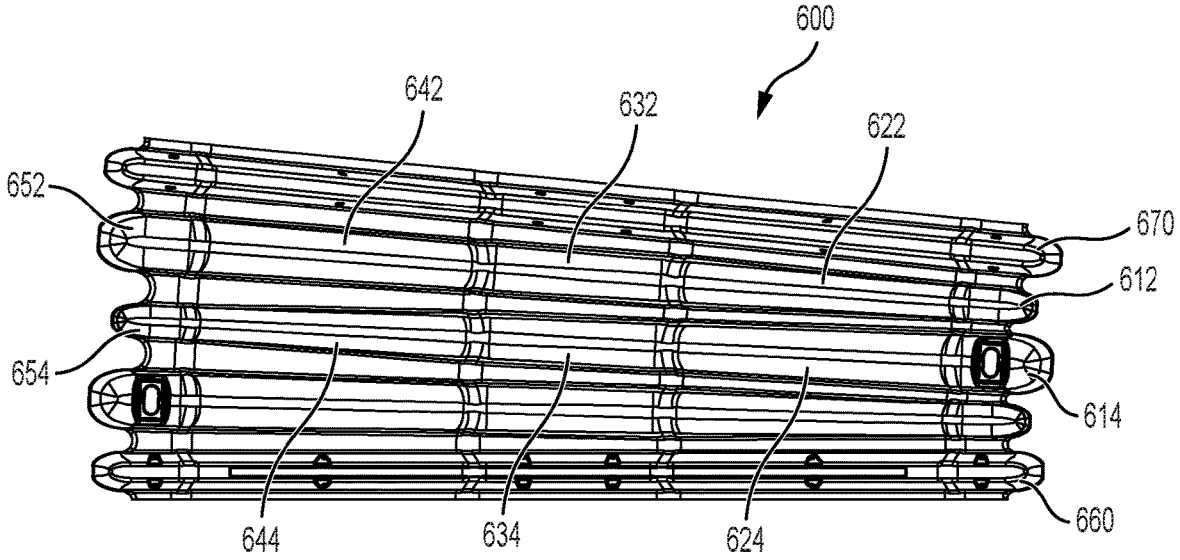
FIG. 26 is a top view of one of the liner sections on the opposite side of centerline shown in FIG. 23.

FIG. 24 is a perspective view of right-hand liner section 600 attached to left-hand liner section 700. FIG. 25 shows left-hand liner section 700 separated from right-hand liner section 600. FIG. 26 shows right-hand liner section 600 separated from left-hand liner section 700.

Figure 27:
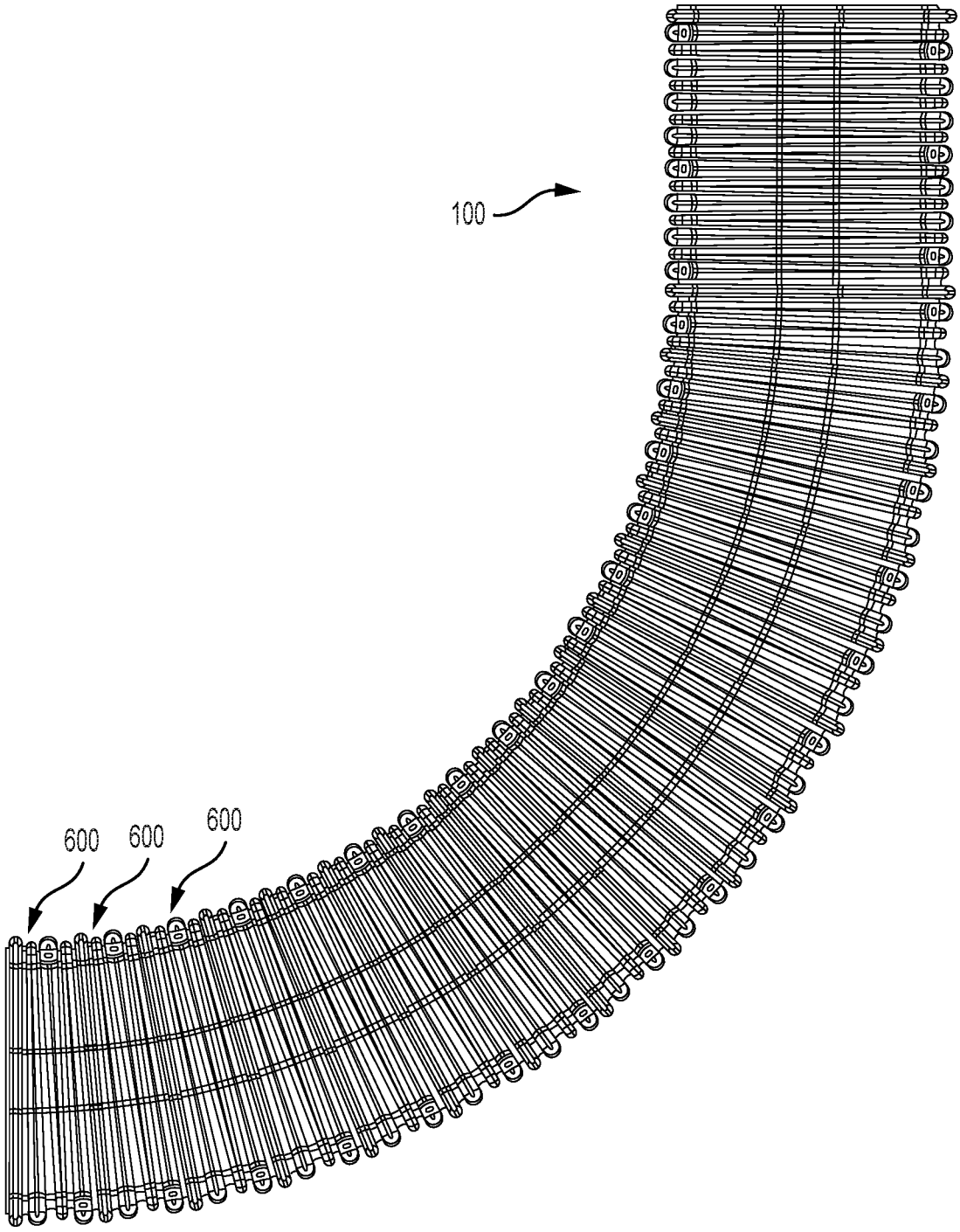
FIG. 27 is a top view of a plurality of one of the liner sections shown in FIG. 25 in an assembled state.

FIG. 27 shows a plurality of right-hand liner section 600 connected to each other to form a 90 degree bend in a ditch liner assembly. Other numbers of right-hand liner section 600 can be connected to each other to form bends of angles other than 90 degrees. Similarly, a number of left-hand liner sections 700 can be attached to each other to form left-hand bends of different angles. Left-hand liner section 700 and right-hand liner section 600 can be formed from a single liner section manufactured with a cut line CL (shown in FIG. 23) separating left-hand liner section 700 and right-hand liner section 600 to produce transition portions of the liner system. In embodiments, each of left-hand liner section 700 and right-hand liner section 600 if formed to create an angle of 5.6 degrees and when joined together, each liner section increases the turning radius by an additional 5.6 degrees. As shown in FIG. 27, a total of 16 elbow will complete a 90 degree turn. If straight liner sections were used and bent to form a bend, stress would be created on the compression side causing buckling of the liner and uplifting on the tension side. Liner sections 600, 700 allow the system to be installed and make gradual turns in direction, relieving the compression and tension in the corrugated straight sections.

Figure 28:
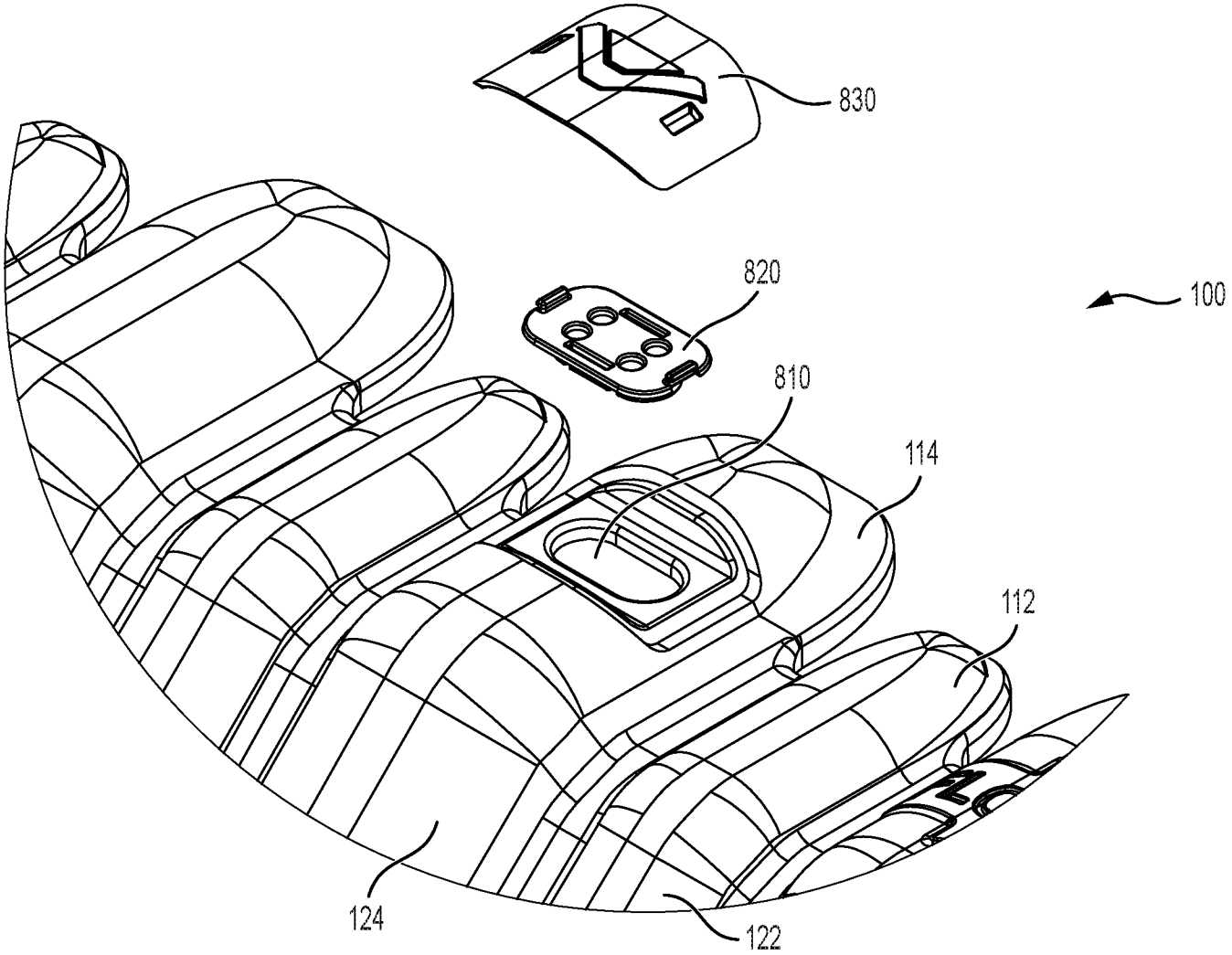
FIG. 28 is a partial perspective view of the liner section shown in FIG. 1.
Figure 30:
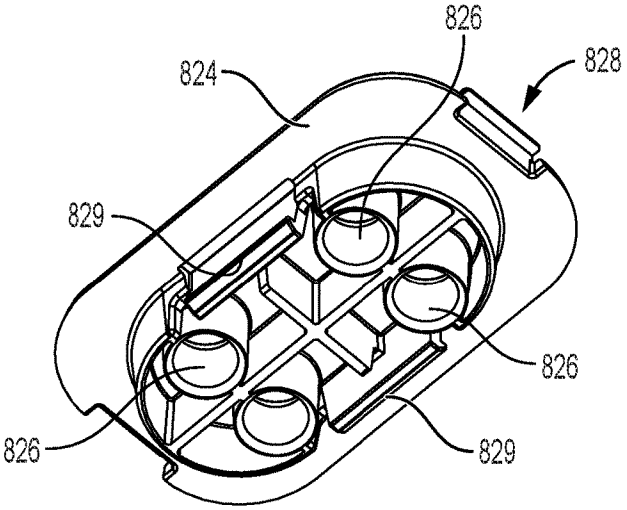
FIG. 30 is a bottom perspective view of the anchor port lock plate shown in FIG. 29.
Figure 32:
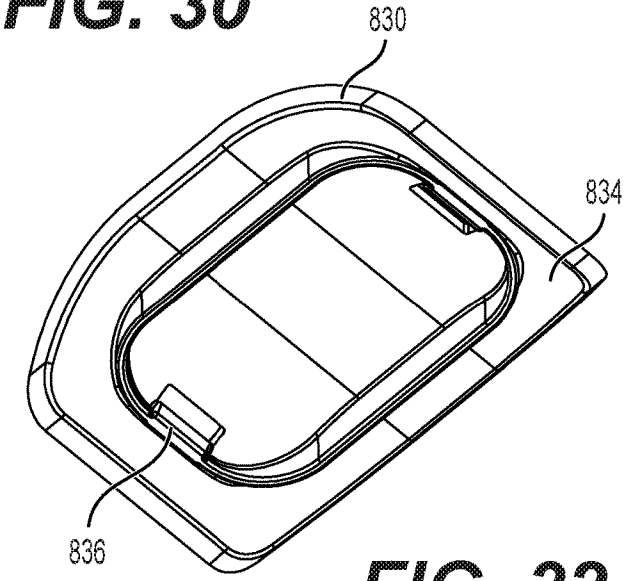
FIG. 32 is a bottom perspective view of the anchor port top cap shown in FIG. 31.
Figure 29:
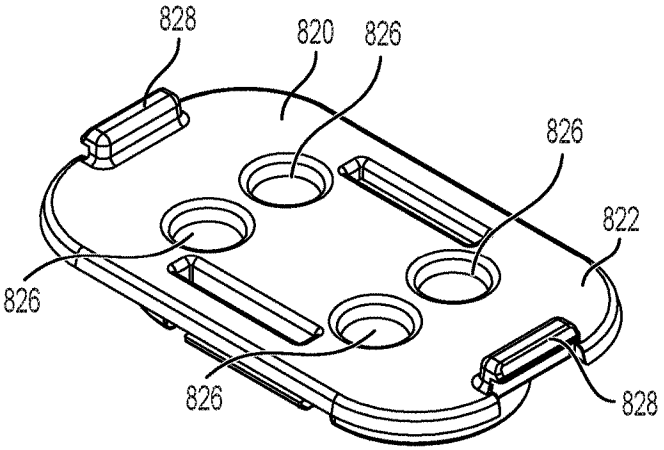
FIG. 29 is a top perspective view of an anchor port lock plate in accordance with embodiments of the invention.
Figure 31:
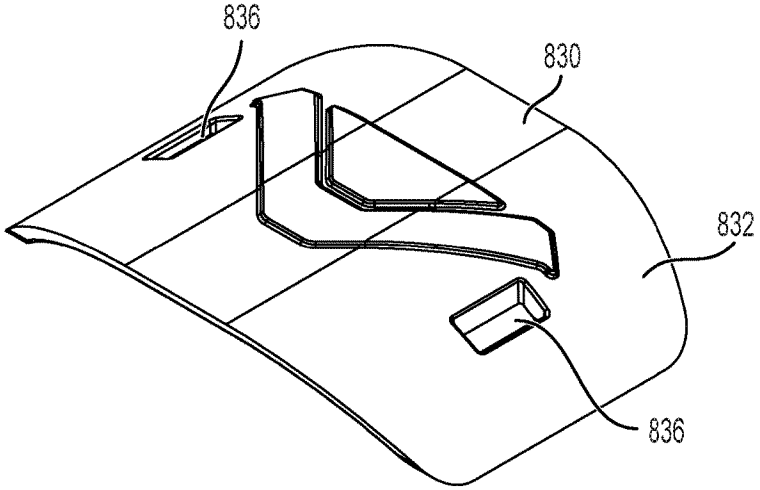
FIG. 31 is a top perspective view of an anchor port top cap in accordance with embodiments of the invention.

FIG. 28 is an exploded view of an anchor port assembly in accordance with embodiments of the invention. FIG. 28 shows a formed anchor port 810 in section 114 of liner 100. Liner 100 includes a plurality of formed anchor ports 810. Also shown in FIG. 28 is an anchor port lock plate 820 and an anchor port top cap 830. FIG. 29 shows anchor port lock plate 820 having a top side 822 and a plurality of holes 826. Anchor port 820 is provided in this example with two tabs 828 that hold anchor port top cap 830 in position on anchor port lock plate 820. FIG. 30 shows anchor port lock plate 820 having a bottom side 824 and two protrusions 829 that engage corresponding features in liner 100 to hold anchor port lock plate 820 in position on liner 100. FIG. 31 shows anchor port top cap 830 having two slots 836 in a top side 832 that secure tabs 828 of anchor port lock plate 820. FIG. 32 shows an under-side 834 of anchor port top cap 830.

Figure 33:
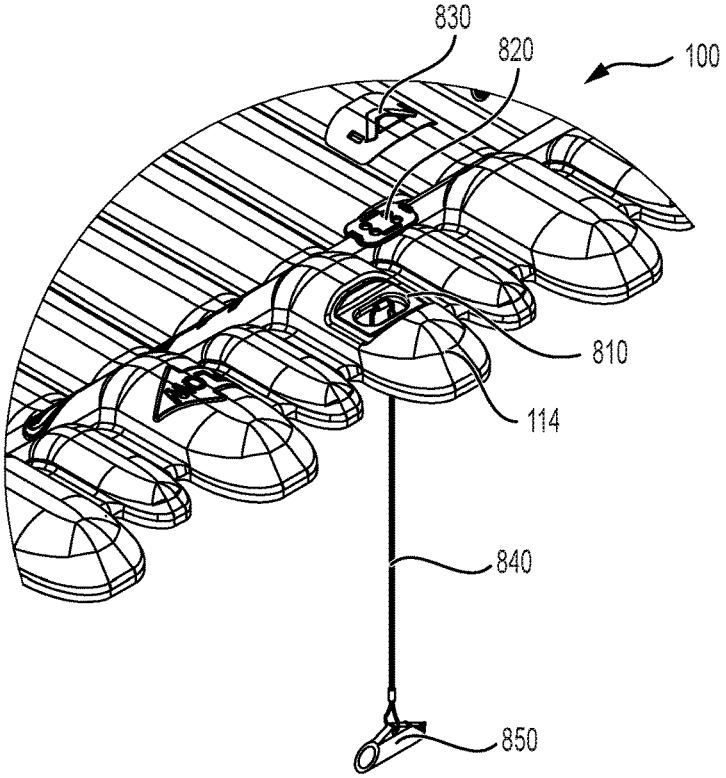
FIG. 33 is a perspective view of an anchor and cable assembly in accordance with embodiments of the invention.
Figure 34:
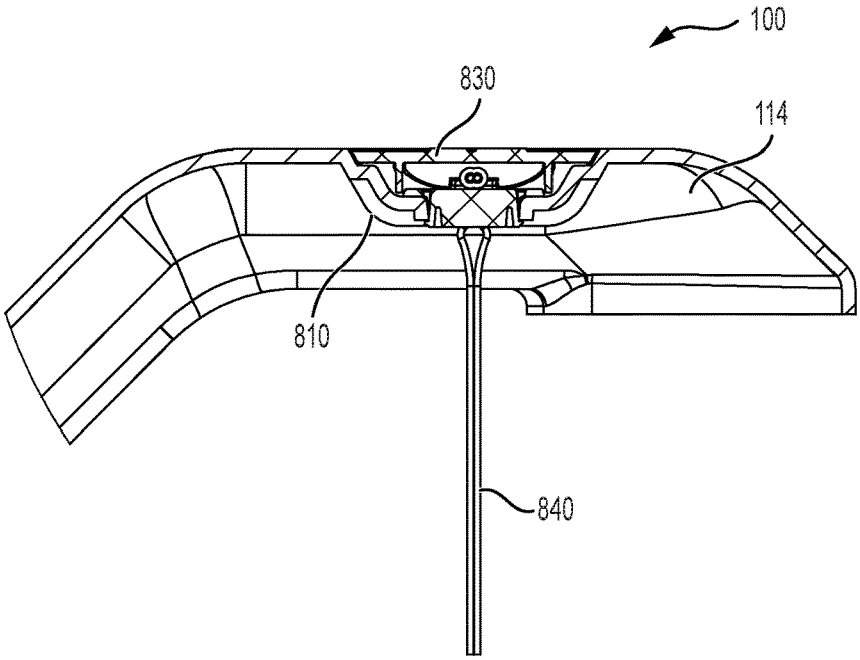
FIG. 34 is a sectional view of the anchor and cable assembly shown in FIG. 33.
Figure 36:
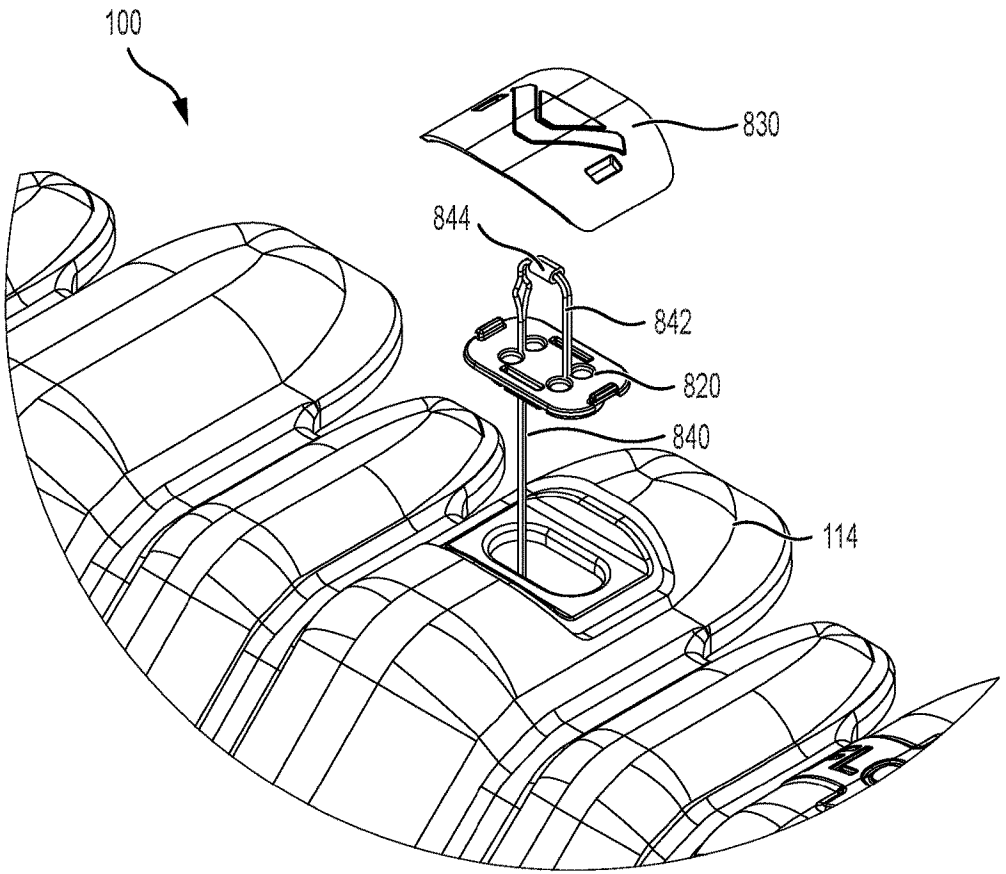
FIG. 36 is a partial perspective view of the liner section shown in FIG. 1 and the anchor and cable assembly shown in FIG. 33.
Figure 35:
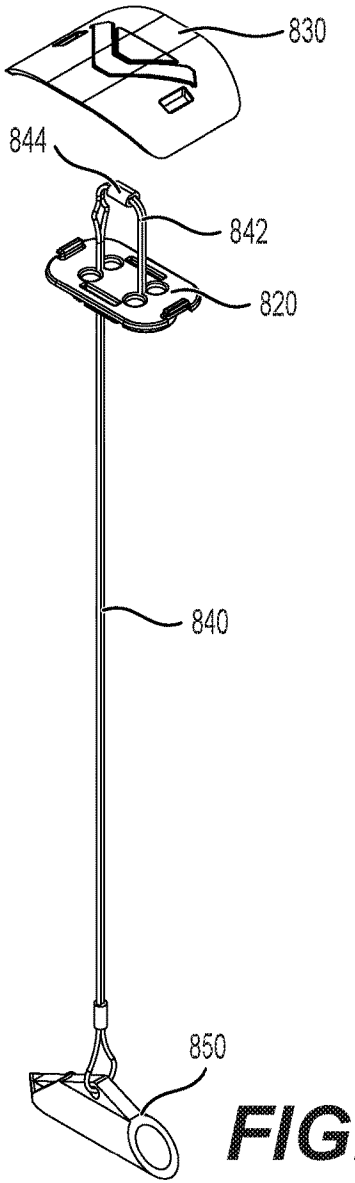
FIG. 35 is a perspective view the anchor and cable assembly shown in FIG. 33.

FIG. 33 shows an earth anchor 850 positioned at a distance below anchor formed port 810 such that when earth anchor 850 is positioned horizontally and buried in the ground, earth anchor 850 secures liner 100 to the ground via two cables 840 tethered to anchor port lock plate 820 secured to liner 100 at the formed anchor port 810. Cables 840 attached to earth anchor 850, when tensioned upward, force earth anchor 850 to move from a vertical insertion position to the horizontal position shown in FIG. 33. In embodiments, earth anchor 850 is installed through formed anchor port 810 after liner 100 is positioned in the ditch. Cables 840 are passed through holes 826 for the purpose of securing cable 840 to liner 100 and anchoring liner 100 to the ground. In embodiments, earth anchor 850 is attached to one cable 840 which is threaded through an eyelet of earth anchor 850 and is crimped such that cable 840 is folded in half such that two sections of cables 840 extend upward. Earth anchor 850 is driven into the ground with a rod and the two sections of cable 840 are exposed above the ground. The two sections of cable 840 are threaded through the bottom of anchor port lock plate 820. One section of cable 840 is threaded through one hole 826 and the other section of cable 840 is threaded through a separate hole 826. The sections of cable 840 are pulled tight, snapping anchor port lock 820 into anchor port 810. A crimp 844 is placed on the two sections of cable 840 above anchor port lock plate 820. The remaining length of cable 840 are then threaded through holes 826, leaving the remaining sections underneath liner 100, protecting them from the elements. Anchor port top cap 830 is placed over formed anchor port 810 and secured to anchor port lock plate 820. FIG. 34 is a sectional view showing the earth anchor assembly. FIG. 35 is an exploded view of the elements of the earth anchor assembly. FIG. 36 shows the routing of cable 840 including a down-turned section 842 of cable 840 and crimp 844.

Figure 37:
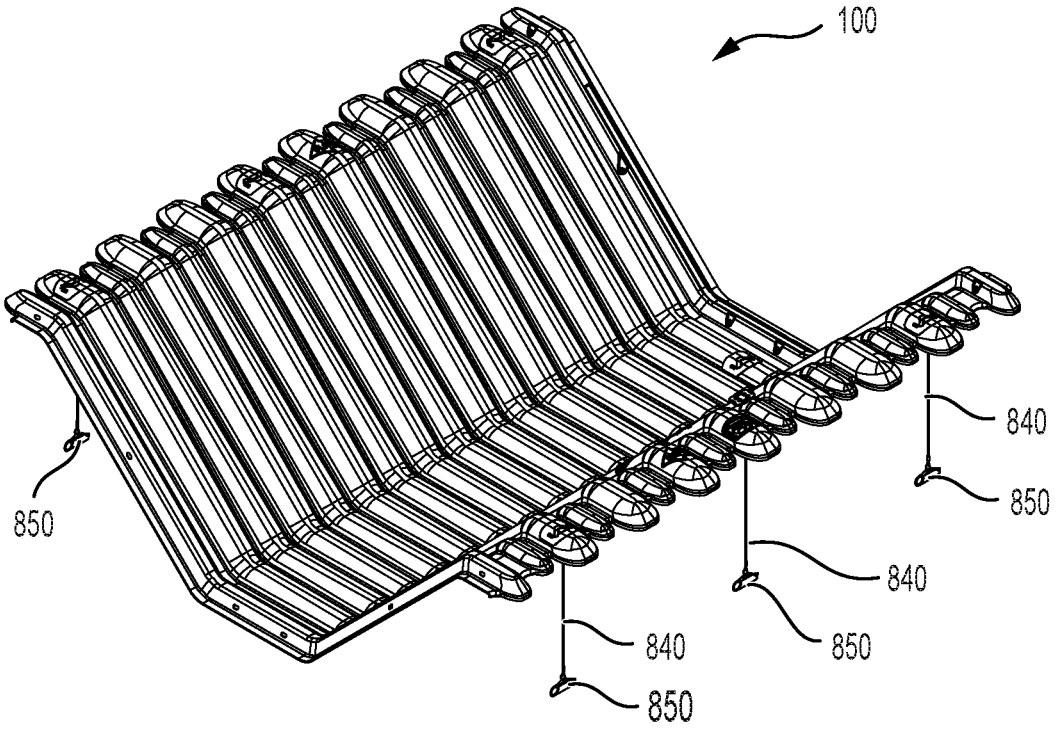
FIG. 37 is a perspective view of the liner section shown in FIG. 1 and a plurality of the anchor and cable assembly shown in FIG. 33.
Figure 38:
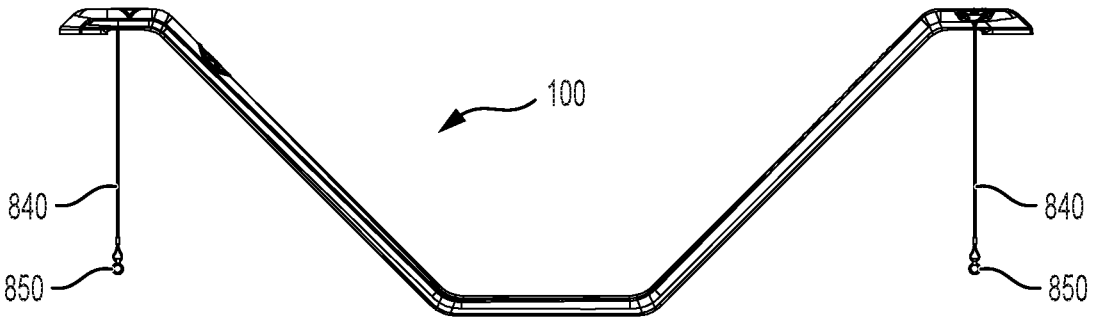
FIG. 38 is an end view of the liner section and the anchor and cable assemblies shown in FIG. 37.

FIG. 37 shows a plurality of earth anchors 850 secured to liner 100. FIG. 38 is an end view of liner 100 as shown in FIG. 37.

An embodiment of the present invention relates to a method for directing water that includes a flexible ditch liner, which can optionally be formed from a plurality of interconnected sections, which can optionally have a gasket disposed between the plurality of sections at the location of the interconnections. The ditch liner can have one or more openings disposed in an at least substantially vertical surface thereof, when disposed in its intended operating position. A valve can be provided to communicably couple to the ditch liner at or around the one or more openings. The valve can include a front mounting plate and a backer plate that can be coupled thereto such that a gate of the valve and a front mounting plate can be disposed on an inside of a portion of the liner and the backing plate can be disposed on an exterior of the liner, thus sandwiching the liner between the front mounting plate and the backing plate. In one embodiment, the backing plate not only assists in securing the valve to the liner, but the backing plate can also help to provide rigidity to the liner around the gate area.

An embodiment of the present invention relates to a ditch liner having at least one liner section which comprises a plurality of corrugations having a first end and a second end, wherein the first end is larger than the second end and wherein the corrugations are arranged such that at least some corrugations have a first end disposed next to a second end of an adjacent corrugation, while a centerline of the adjacent corrugations remains at least substantially equidistant from one another along their length.

An embodiment includes a method of channeling a fluid comprising disposing at least one liner section in a ditch, securing the at least one liner section with an earth anchor, securing the earth anchor to the at least one liner section at an anchor port by securing an anchor port lock to the earth anchor, positioning the anchor port lock within the anchor port. The method can optionally include disposing terminal end portions of a cable of an earth anchor into openings in the anchor port lock. The method can further include covering the anchor port lock with an anchor port top cap. The anchor port top cap can optionally be secured over the anchor port using an interlocking tab and/or an interference fit between the anchor port top cap and a portion of the liner section.

Although the presently claimed invention has been described in detail with particular reference to these preferred embodiments, other embodiments can achieve the same results. Note that in the specification and claims, "about" or "approximately" means within twenty percent (20%) of the numerical amount cited. The term "a", "an" or "the" means one or more unless otherwise indicated.

It will be appreciated that variants of the above-disclosed and other features and functions, or alternatives thereof, may be combined into many other different systems or applications. Any of the features described above can be combined with any other feature described above as long as the combined features are not mutually exclusive. Various presently unforeseen or unanticipated alternatives, modifications, variations or improvements therein may be subsequently made by those skilled in the art which are also intended to be encompassed by the invention.

What is claimed is:

1. A ditch liner having a longitudinal direction and a transverse direction perpendicular to the longitudinal direction, the ditch liner comprising:

a first corrugation extending in the transverse direction, and having a first angled section having a width in the longitudinal direction, a second angled section having a width in the longitudinal direction, and a central section positioned between the first angled section and the second angled section, and having a width in the longitudinal direction; and a second corrugation extending in the transverse direction and having a first angled section having a width in the longitudinal direction, a second angled section having a width in the longitudinal direction, and a central section positioned between the first angled section of the second corrugation and the second angled section of the second corrugation, and having a width in the longitudinal direction, wherein the first angled section of the first corrugation is adjacent to the first angled section of the second corrugation in the longitudinal direction, the second angled section of the first corrugation is adjacent to the second angled section of the second corrugation in the longitudinal direction, the central section of the first corrugation is adjacent to the central section of the second corrugation in the longitudinal direction, the width of the central section of the first corrugation is equal to the width of the central section of the second corrugation at at least two locations along the transverse direction; and the width of the first angled section of the first corrugation is greater than the width of the first angled section of the second corrugation at a first location along the transverse direction.

2. The ditch liner of claim 1, wherein the width of the central section of the first corrugation is equal to the width of the central section of the second corrugation at all locations along the transverse direction.

3. The ditch liner of claim 1, wherein the width of the second angled section of the first corrugation is less than the width of the second angled section of the second corrugation at a second location along the transverse direction.

4. The ditch liner of claim 1, wherein the width of the first angled section of the first corrugation is different at different locations along the transverse direction.

5. The ditch liner of claim 4, wherein the width of the second angled section of the first corrugation is different at different locations along the transverse direction.

6. The ditch liner of claim 1, wherein the width of the central section of the first corrugation is constant at all locations along the transverse direction.

7. The ditch liner of claim 1, wherein the first angled section of the first corrugation has a height perpendicular to its width, the first angled section of the second corrugation has a height perpendicular to its width, and the height of the first angled section of the first corrugation at the first location is different than the height of the first angled section of the second corrugation at the first location.

8. The ditch liner of claim 7, wherein the second angled section of the first corrugation has a height perpendicular to its width, the second angled section of the second corrugation has a height perpendicular to its width, and the height of the second angled section of the first corrugation at the second location is different than the height of the second angled section of the second corrugation at the second location.

9. The ditch liner of claim 1, wherein the central section of the first corrugation has a height perpendicular to its width, the central section of the second corrugation has a height perpendicular to its width, and the height of the central section of the first corrugation is equal to the height of the central section of the second corrugation.

10. The ditch liner of claim 1, wherein the first corrugation further comprises a first upper section extending from the first angled section of the first corrugation such that the first angled section of the first corrugation is positioned between the first upper section and the central section of the first corrugation;

an anchor port located in the first upper section; and an anchor port lock attached to the anchor port.

11. The ditch liner of claim 10, further comprising an anchor configured to engage earth below the first upper section, and a cable connecting the anchor to the anchor port lock, wherein the cable and the anchor port lock are located entirely below an upper surface of the first upper section.

12. The ditch liner of claim 1, wherein the first angled section is in a first plane, the second angled section is in a second plane, the first central section is in a third plane, and the first plane, the second plane, and the third plane are all different planes.

13. The ditch liner of claim 1, further comprising a first edge corrugation that is located on an edge of the ditch liner in the longitudinal direction, the first edge corrugation having a gasket-receiving recess, wherein the gasket-receiving recess is configured to receive a gasket positioned between the gasket-receiving recess and an edge corrugation of a second ditch liner such that the gasket is located between the gasket-receiving recess and the edge corrugation of the second ditch liner.

14. The ditch liner of claim 13, further comprising the gasket, the gasket being a hydrophilic material.

15. The ditch liner of claim 1, further comprising a flow port extending from the first angled section in the transverse direction, the flow port having an opening configured to allow a liquid contained by the ditch liner to exit the ditch liner through the opening.

16. The ditch liner of claim 15, further comprising a gate positioned at the opening, the gate being movable between a closed position at which the liquid is prevented from passing through the opening, and an open position at which the liquid can pass through the opening.

17. The ditch liner of claim 1, wherein a length of the ditch liner in the longitudinal direction is different at different locations along the transverse direction.

18. The ditch liner of claim 1, wherein a length of the ditch liner in the longitudinal direction of the ditch liner at one end in the transverse direction is a first length, a length of the ditch liner in the longitudinal direction of the ditch liner at an opposite end in the transverse direction is a second length, the first length is a shortest length of the ditch liner at any location along the transverse direction, and the second length is a longest length of the ditch liner at any location along the transverse direction.

19. A ditch liner assembly comprising a plurality of the ditch liners of claim 18 assembled together such that the one ends of two adjacent ones of the ditch liners are connected to each other, and the opposite ends of the two adjacent ones of the ditch liners are connected to each other.

20. The ditch liner of claim 1, wherein the width of the second angled section of the first corrugation is different at different locations along the transverse direction.

* * * * *